US012471703B1

(12) United States Patent
Allen

(10) Patent No.: US 12,471,703 B1
(45) Date of Patent: Nov. 18, 2025

(54) LOCKER WITH AIR CONDITIONING SYSTEM IN HINGE BAR

(71) Applicant: AIM Design, LLC, Desoto, TX (US)

(72) Inventor: Sam Allen, Maypearl, TX (US)

(73) Assignee: AIM Design, LLC, Desoto, TX (US)

( * ) Notice: Subject to any disclaimer, the term of this patent is extended or adjusted under 35 U.S.C. 154(b) by 0 days.

(21) Appl. No.: 18/787,590

(22) Filed: Jul. 29, 2024

Related U.S. Application Data

(63) Continuation-in-part of application No. 18/450,208, filed on Aug. 15, 2023, which is a continuation-in-part of application No. 17/828,940, filed on May 31, 2022, now Pat. No. 11,723,460, which is a continuation of application No. 16/546,977, filed on Aug. 21, 2019, now Pat. No. 11,344,119, which is a continuation-in-part of application No. 15/897,875, filed on Feb. 15, 2018, now Pat. No. 10,690,361, which is a (Continued)

(51) Int. Cl.

| | |
|---|---|
| ***A47B 81/00*** | (2006.01) |
| ***A47B 83/00*** | (2006.01) |
| ***A47C 1/00*** | (2006.01) |
| ***A47C 7/02*** | (2006.01) |
| ***A47C 7/40*** | (2006.01) |
| ***A63B 71/00*** | (2006.01) |
| ***F24F 7/007*** | (2006.01) |

(52) U.S. Cl.
CPC ..... *A47B 81/00* (2013.01); *A47B 83/00* (2013.01); *A47C 1/00* (2013.01); *A47C 7/024* (2013.01); *A47C 7/405* (2013.01); *A47C 7/407* (2013.01); *A63B 71/0036* (2013.01); *F24F 7/007* (2013.01)

(58) Field of Classification Search
CPC ..... A47B 81/00; A47B 83/00; A47C 1/00; A47C 7/024; A47C 7/405; A47C 7/407; A63B 71/0036; D06F 58/10; F24F 7/007; A47F 3/001
See application file for complete search history.

(56) References Cited

U.S. PATENT DOCUMENTS

| | | | |
|---|---|---|---|
| 2,429,050 | A | 10/1947 | Decker |
| 2,759,529 | A | 8/1956 | Hagadorn |

(Continued)

FOREIGN PATENT DOCUMENTS

| | | | |
|---|---|---|---|
| CN | 208264046 | U * | 12/2018 |
| JP | 045675 | U | 4/1990 |

(Continued)

OTHER PUBLICATIONS

Translation, CN-208264046-U (Year: 2018).*

(Continued)

*Primary Examiner* — Jessica Yuen
(74) *Attorney, Agent, or Firm* — James E. Walton

(57) ABSTRACT

A locker includes a pair of spaced-apart upstanding sidewalls and at least one shelf extending between the sidewalls, the shelf and sidewalls defining a compartment. A tray is carried on the shelf in the compartment and supported by a pair of rollers and coupled to a pair of rails mounted on the sidewalls above the shelf, wherein the tray slides forward and backward relative to the shelf and rotates about the rollers. Located on the tray are a set of equipment racks for storing and drying equipment when not in use.

15 Claims, 28 Drawing Sheets

Related U.S. Application Data continuation-in-part of application No. 15/832,073, filed on Dec. 5, 2017, now Pat. No. 10,612,846.

(56) References Cited

U.S. PATENT DOCUMENTS

| | | | |
|---|---|---|---|
| 3,475,769 | A | 11/1969 | Fasanella |
| 4,384,191 | A | 5/1983 | Guibert |
| 4,471,537 | A | 9/1984 | Meda |
| 5,369,892 | A | 12/1994 | Dhaemers |
| 5,547,270 | A | 8/1996 | Dang |
| 5,628,551 | A | 5/1997 | Block |
| 6,860,032 | B2 | 3/2005 | Meyer |
| 6,868,621 | B1 | 3/2005 | Grimm et al. |
| 8,365,950 | B2 | 2/2013 | Yuyama et al. |
| 8,496,308 | B2 | 7/2013 | Zabbatino |
| 9,968,807 | B2 | 5/2018 | Squicciarini |
| 11,344,119 | B2 | 5/2022 | Allen |
| 2005/0204579 | A1 | 9/2005 | Rosseau et al. |
| 2005/0278972 | A1 | 12/2005 | Maruca |
| 2006/0112828 | A1 | 6/2006 | Ehlers |
| 2008/0252189 | A1 | 10/2008 | Regan |
| 2011/0025181 | A1 | 2/2011 | Vinke et al. |
| 2011/0074256 | A1 | 3/2011 | Boice |
| 2012/0193312 | A1 | 8/2012 | Sjolander et al. |
| 2013/0199581 | A1 | 8/2013 | Christopherson |
| 2016/0258108 | A1 | 9/2016 | Jindra et al. |
| 2017/0244262 | A1 | 8/2017 | Schadow et al. |
| 2017/0290726 | A1 | 10/2017 | Hovenden et al. |
| 2021/0080983 | A1 | 3/2021 | Meggers et al. |

FOREIGN PATENT DOCUMENTS

| | | | |
|---|---|---|---|
| JP | 1185044 | A | 3/1999 |
| JP | 11201625 | A | 7/1999 |
| JP | 2010194275 | A | 9/2010 |

OTHER PUBLICATIONS

SchoolLockers.com. Football Equipment Lockers, Feb. 28, 2015, SchoolLockers.com, p. 2 (Year: 2015).
Clemson Football Operations Facility Construction Documents, dated Mar. 15, 2016, p. 290.
Office Action dated Apr. 5, 2019 from U.S. Appl. No. 15/804,286.
Amendment dated Jun. 25, 2019 from U.S. Appl. No. 15/804,286.
Final Office Action dated Dec. 11, 2019 from U.S. Appl. No. 15/804,286.
Amendment After Final dated Jan. 13, 2020 from U.S. Appl. No. 15/804,286.
Advisory Action dated Mar. 10, 2020 from U.S. Appl. No. 15/804,286.
RCE and Amendment dated Mar. 23, 2020 from U.S. Appl. No. 15/804,286.
Office Action dated May 1, 2020 from U.S. Appl. No. 15/804,286.
Amendment dated Jun. 2, 2020 from U.S. Appl. No. 15/804,286.
Final Office Action dated Aug. 5, 2020 from U.S. Appl. No. 15/804,286.
Amendment After Final dated Sep. 30, 2020 from U.S. Appl. No. 15/804,286.
Advisory Action dated Oct. 15, 2020 from U.S. Appl. No. 15/804,286.
RCE and Amendment dated Oct. 20, 2020 from U.S. Appl. No. 15/804,286.
Notice of Allowance dated Nov. 3, 2020 from U.S. Appl. No. 15/804,286.
Office Action dated Jun. 10, 2019 from U.S. Appl. No. 15/832,073.
Amendment dated Jul. 17, 2019 from U.S. Appl. No. 15/832,073.
Final Office Action dated Oct. 24, 2019 from U.S. Appl. No. 15/832,073.
Response After Final dated Dec. 23, 2019 from U.S. Appl. No. 15/832,073.
Notice of Allowance dated Jan. 15, 2020 from U.S. Appl. No. 15/832,073.
Preliminary Amendment dated May 23, 2019 from U.S. Appl. No. 15/897,875.
Office Action dated Dec. 20, 2019 from U.S. Appl. No. 15/897,875.
Amendment dated Jan. 16, 2020 from U.S. Appl. No. 15/897,875.
Notice of Allowance dated Apr. 23, 2020 from U.S. Appl. No. 15/897,875.
Preliminary Amendment dated Sep. 18, 2019 from U.S. Appl. No. 16/546,977.
Preliminary Amendment dated Jun. 11, 2020 from U.S. Appl. No. 16/546,977.
Notice of Allowance dated Feb. 4, 2022 from U.S. Appl. No. 16/546,977.
Office Action dated Nov. 25, 2022 from U.S. Appl. No. 17/828,940.
Amendment dated Feb. 21, 2023 from U.S. Appl. No. 17/828,940.
Notice of Allowance dated Mar. 17, 2023 from U.S. Appl. No. 17/828,940.

* cited by examiner

LOCKER WITH AIR CONDITIONING SYSTEM IN HINGE BAR

CROSS-REFERENCE TO RELATED APPLICATIONS

This application is a continuation-in-part of U.S. patent application Ser. No. 18/450,208, filed 15 Aug. 2023, titled "Ventilated Locker with Equipment Rack," which is a continuation-in-part of U.S. patent application Ser. No. 17/828,940, filed 31 May 2022, titled "Ventilated Locker with Equipment Rack," which issued as a U.S. Pat. No. 11,723,460 on 15 Aug. 2023, which is a continuation of U.S. patent application Ser. No. 16/546,977, filed 21 Aug. 2019, titled "Ventilated Locker with Equipment Rack," which issued as a U.S. Pat. No. 11,344,119 on 31 May 2022, which is a continuation-in-part of U.S. patent application Ser. No. 15/897,875, filed 15 Feb. 2018, titled "Ventilated Locker," which issued as a U.S. Pat. No. 10,690,361 on 23 Jun. 2020, which is a continuation-in-part of U.S. patent application Ser. No. 15/832,073, filed 5 Dec. 2017, titled "Ventilated Locker," which issued as a U.S. Pat. No. 10,612,846 on 7 Apr. 2020, all of which are hereby incorporated by reference in their entirety for all purposes.

BACKGROUND

1. Field of the Invention

The present invention relates generally to improvements in lockers or storage cabinets used in athletic or sporting facilities, and more specifically to compartments within such lockers configured and adapted especially for storing equipment such as pads or helmets.

3. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers may incorporate storage for specific items of equipment, such as helmets and shoes, and features promoting comfort and luxury. One consistent problem in locker rooms of all types is the storage of heavy, cumbersome equipment such as football, lacrosse, or hockey helmets and pads. There is a constant need for improvement in this and other aspects of such lockers.

BRIEF DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
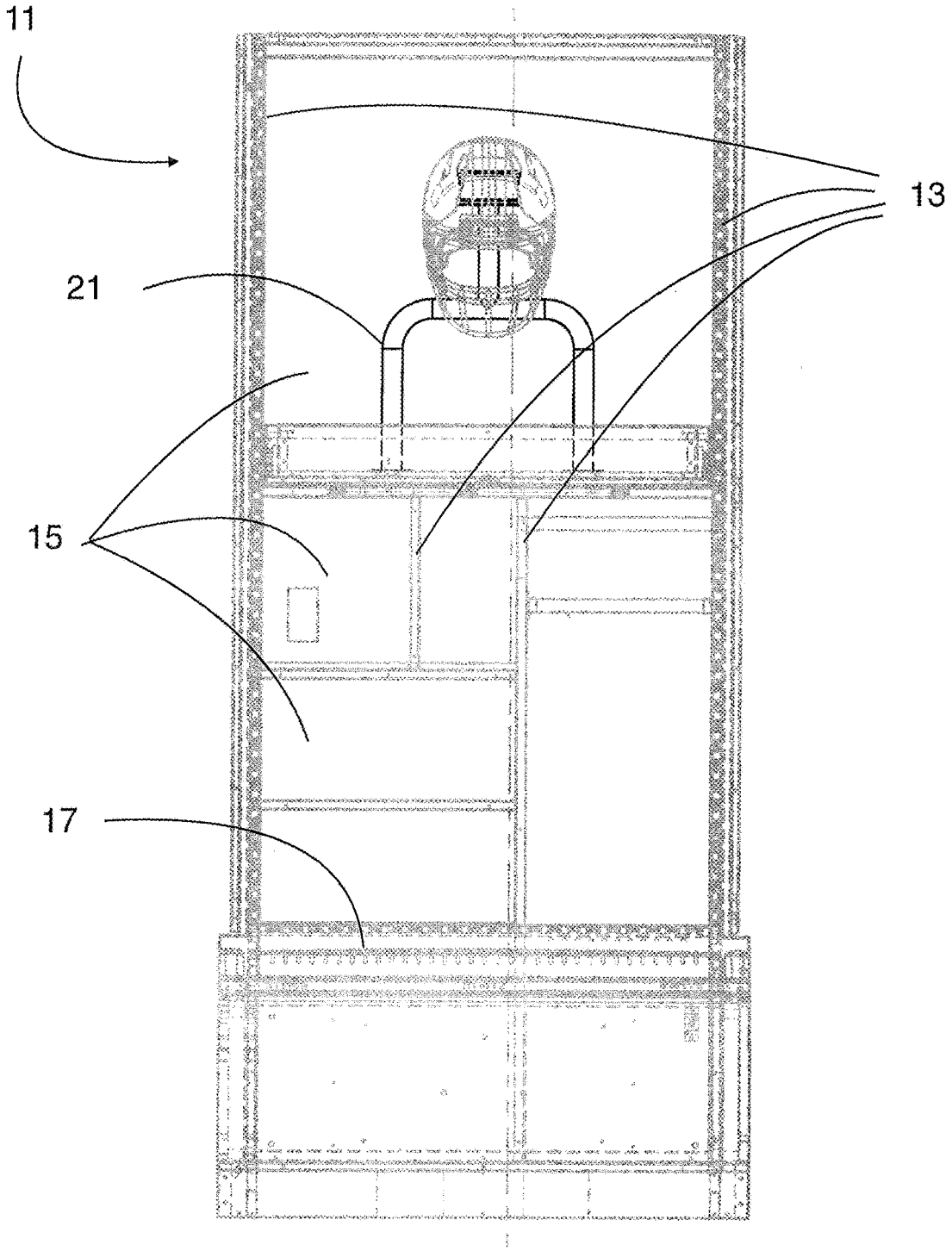
FIG. 1 is a elevation view, partially in section, of a locker incorporating the equipment storage fixture or rack according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. It is also appreciated that the use of "a" or "an" before a noun naming an object is construed to be that the noun refers to both the singular and the plural.

Figure 2:
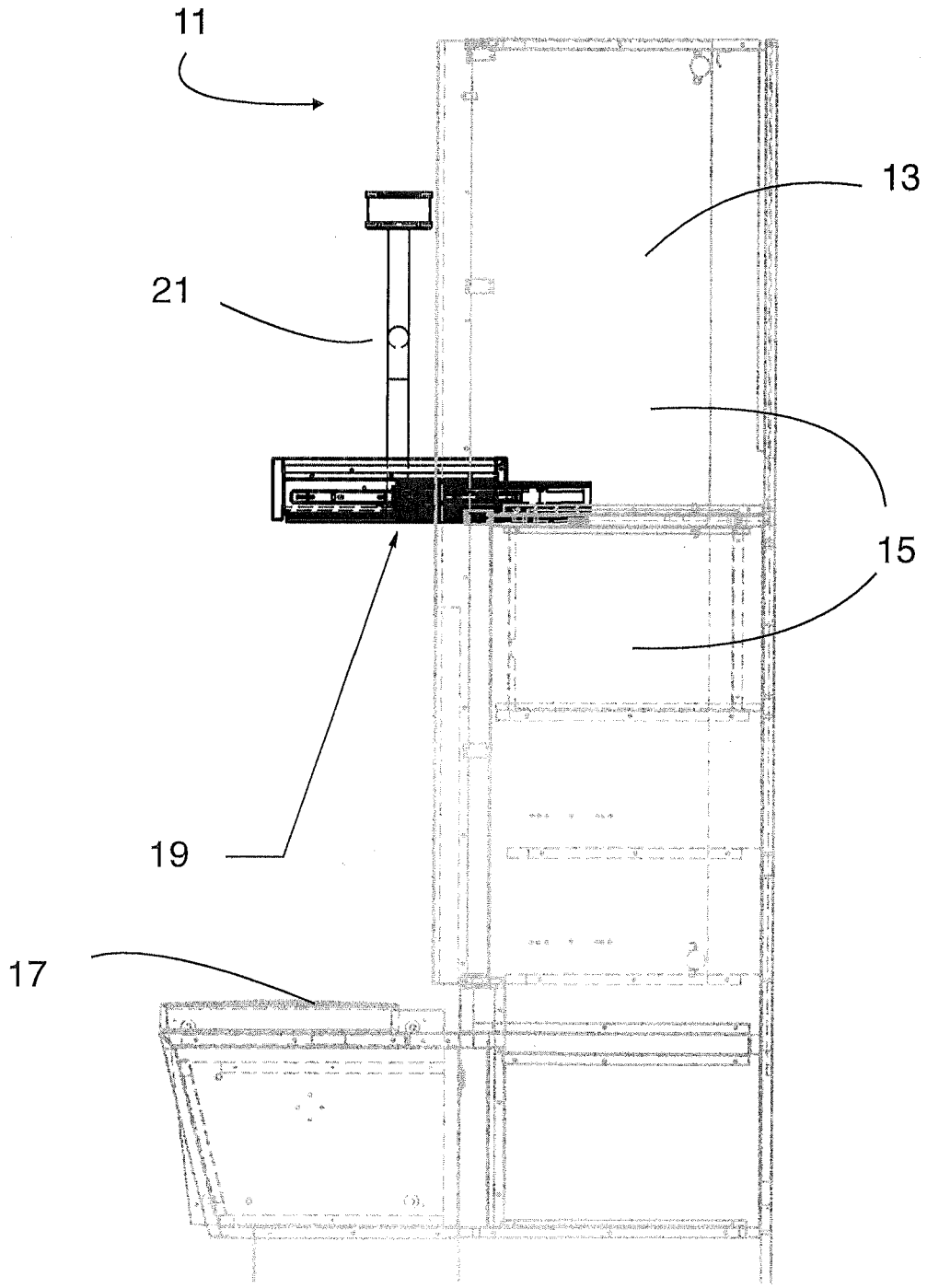
FIG. 2 is a side elevation view, partially in section, of the locker of FIG. 1.

Referring now to FIGS. 1 and 2 in the drawings, a locker 11 according to an embodiment of the present application is depicted. Locker 11 comprises a pair of upstanding sidewalls 13 that generally define the extent of the locker. Each locker 11 may be installed adjacent to another, similar or identical locker, with its rear against a wall, and its front facing the interior of the locker room.

Between the sidewalls 13 of locker 11, a plurality of compartments 15 are defined by shelves or other horizontally extending surfaces or platforms. As used herein, "sidewall" or "sidewalls" may refer to either "main" sidewalls 13 or other upstanding or generally vertical sidewalls arranged between the "main" sidewalls. Multiple additional sidewalls 13 may be placed between the "main" or exterior sidewalls 13 to define compartments 15 in cooperation with generally horizontally extending shelves. These additional sidewalls and shelves may be referred to as "dividers" or "divider walls." Each compartment 15 may be sized and otherwise configured for storage of clothing or sporting equipment or other items and may include at least one door, which may be lockable. Locker 11 may also be provided with a bench seat 17 or similar seating arrangement that sits atop a "footlocker" or lowermost compartment of locker 11, which extends forward of the remainder of locker 11, and may be divided into multiple compartments.

Among the compartments in locker 11 according to the present application may be a helmet or pad compartment, generally located at the upper end of locker 11. An equipment fixture or rack 21 may be disposed on the shelf defining the lower extent of the helmet or pad compartment. Rack 21 may be configured and arranged to store a football or similar helmet alone or together with shoulder pads or other protective equipment. The shelf on which rack 21 is mounted may preferably be provided with drawer slides to permit the shelf and rack 21 to move horizontally in and out of the compartment of locker 11 between an extended or deployed position and a stored position for ease of use, as shown in FIG. 2 (see also FIG. 5, below). The shelf may also be provided with a tilting feature to permit downward tilting of the shelf when pulled forward or out of the compartment, again for ease of placing and removing equipment on rack 21. Rack 21 may be mounted directly to a shelf, with or without sliding or tilting features, or to a separate platform or other member carried by the shelf or sidewall 13.

Figure 3A:
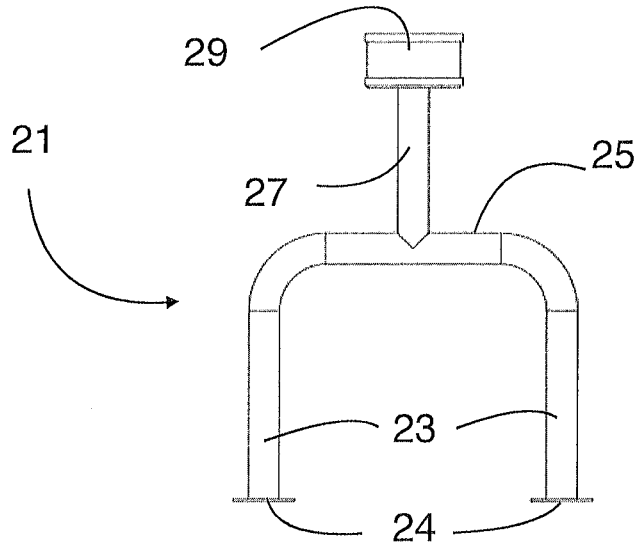
FIGS. 3A and 3B are elevation and perspective views of the equipment storage fixture or rack shown in FIGS. 1 and 2.
Figure 3B:
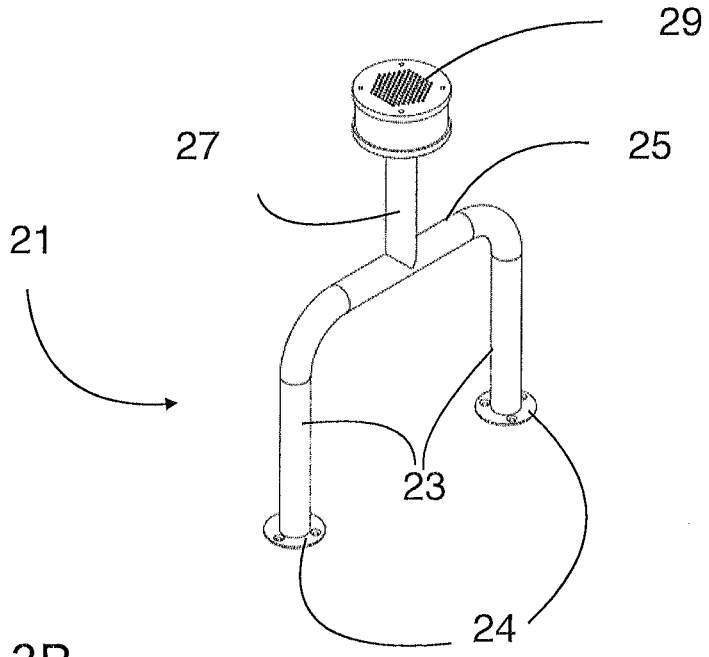

Referring now also to FIGS. 3A and 3B, rack 21 may comprise a pair of upstanding, spaced-apart posts 23, which are secured to the shelf or platform by flanges 24. Posts 23 may be connected at their upper ends by a cross-member or crossbar 25. The distance or dimension between posts 25 may be narrower than a pair of shoulder pads and the height of crossbar 25 may be sufficient to support the pads above the shelf so that the pads contact only rack 21. A helmet post 27 may extend upwardly from approximately the center or middle of crossbar 25 and may terminate in a helmet support member 29, which contacts and supports the interior of a helmet. Helmet post 27 may be dimensioned so that a helmet is suspended entirely above crossbar 25 (as shown in FIG. 1). Helmet support member 29 may incorporate a ventilator or helmet ventilation system. The ventilator may be an electric fan contained in a perforated housing that is operably associated with support member 29, preferably a model QFR0812SH-F00 from Delta Products Corp., 46101 Fremont Blvd, Fremont, CA 94538, U.S.A., The fan may circulate air in, around, and through a helmet or other equipment stored on post 27 for drying and deodorization purposes. Alternatively, the ventilator may be coupled to a "forced air" ventilation or air circulation system that is part of locker 11 or a system of lockers or a room HVAC system, as described below in connection with FIGS. 6A through 7C.

The fan may be powered by AC or DC electric current and may be provided with a switch to control its operation. The switch may be actuated by the weight of the helmet on post 27 and support member 29, manually, by a timer, by voice actuation, by detection of the presence of a condition such as heat, moisture, or odor, or the like.

Rack or fixture 21 may be constructed of steel or aluminum tubing, welded or otherwise secured together in sections comprising posts 23, crossbar 25, and post 27 and secured to its shelf by screws or bolts through a flange, as illustrated. The hollow nature of the preferred tubing may permit passage of electric cables and air or other gases for power or ventilation and reduces the overall weight of rack 21.

Figure 4:
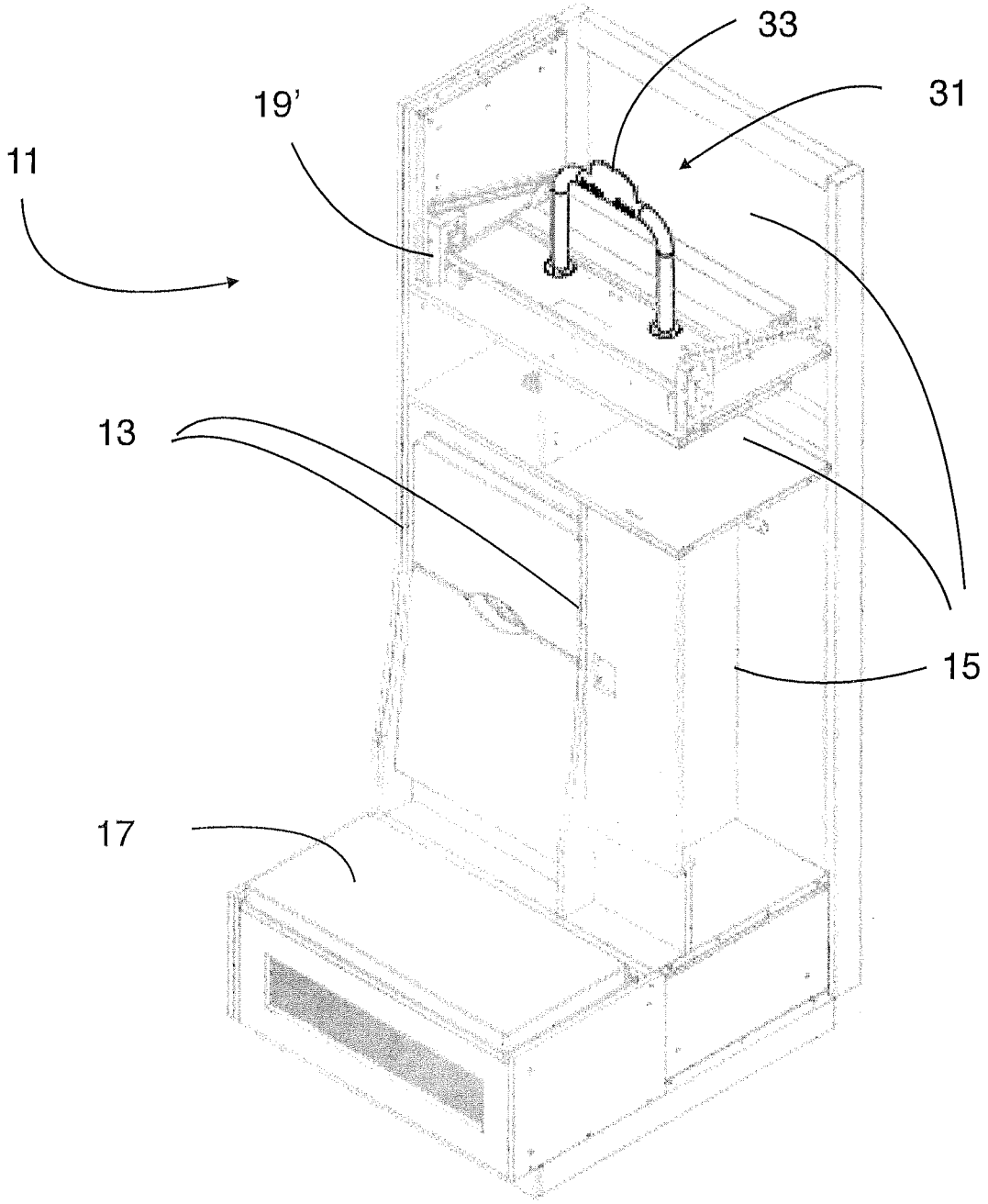
FIG. 4 is a perspective view of a locker incorporating the equipment storage fixture or rack according to a second embodiment of the present application.
Figure 5:
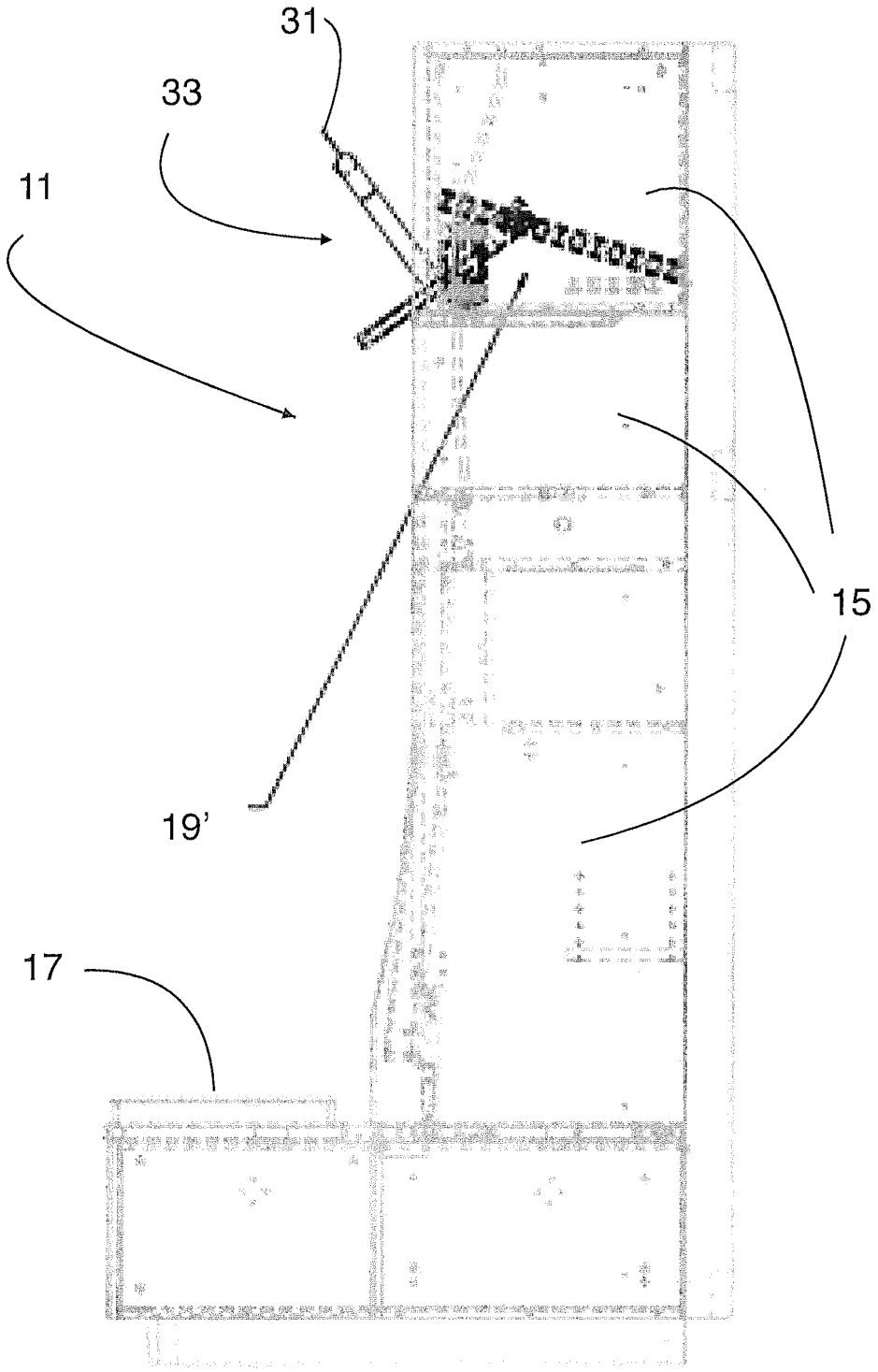
FIG. 5 is a side elevation view, partially in section, of the locker of FIG. 4.

Referring now also to FIGS. 4 and 5, FIGS. 4 and 5 depict a locker 11 similar to that of FIGS. 1 and 2, but incorporating a fixture or rack 31 according to another embodiment of the present application. Fixture or rack 31 is similar in form and operation to that illustrated in FIGS. 3A and 3B, except that helmet post 27 and support member 29 are omitted. This embodiment is intended for storage of pads, e.g. shoulder pads, only, and no helmet. Accordingly, a small vertical projection or tab takes the place of helmet post 27 and serves to help "center" or locate pads on rack 31. Further, as shown in FIG. 5, rack 31 may be mounted on a shelf with a tilting feature 19' that permits forward tilting of shelf and rack 31, with or without sliding the shelf forward or out of the storage compartment so that the shelf and rack 31 are movable between an extended or deployed position and a storage position. Again, rack 31 may be mounted directly to a shelf or to a platform coupled to or carried by the shelf or sidewall 13 of locker 11.

Referring now also to FIGS. 6A through 6D and 7A through 7C in the drawings, two embodiments of lockers 111, 211 according to the present application are depicted. Locker 111, 211 generally comprises a pair of upstanding sidewalls 113, 213 that generally define the extent of the locker. A back wall 115, 215 connects sidewalls 113, 213 at the rear of each locker 111, 211. Each locker 111, 211 may be installed adjacent to another, similar or identical locker, with its rear against a wall, and its front facing the interior of the locker room.

Between the sidewalls 113, 213 of locker 111, 211, a plurality of compartments 117, 217 are defined by shelves or other horizontally extending surfaces or platforms. As used herein, "sidewall" or "sidewalls" may refer to either "main" sidewalls 113, 213 or other upstanding or generally vertical sidewalls arranged between the "main" sidewalls. Multiple additional sidewalls 113, 213 may be placed between the "main" or exterior sidewalls 113, 213 to define compartments 117, 217 in cooperation with generally horizontally extending shelves or platforms. These vertical and horizontal walls may also be referred to as "dividers" or "divider walls" because they further divide compartments. Each compartment 117, 217 may be sized and otherwise configured for storage of clothing or sporting equipment or other items and may include at least one door, which may be lockable. Locker 111, 211 may also be provided with a bench seat 119, 219 or similar seating arrangement.

A plenum 131, 231 may be mounted on the rear or exterior side of back wall 115, 215. Plenum 131, 231 may be connected via duct work (not shown) to the existing HVAC of the locker room or room in which locker 111, 211 is disposed or situated. Plenum 131, 231, may be generally coextensive with back wall 115, 215 or may be smaller or larger. The HVAC system to which plenum 131, 133 is connected may be the conventional heating and cooling system of the building or room in which locker 111, 211 is disposed, or may be a dedicated system for the lockers themselves. Plenum 131, 231 may be connected to HVAC system at its upper end or extent, or to either or both sides, or at the bottom. The HVAC system thus provides (positive pressure) or removes (negative pressure) heated, cooled, and/or dehumidified air to each locker 111, 211, through plenum 131, 231. Plenum may deliver or remove air from locker 111.

Plenum 131, 231 may communicate air from the HVAC system to the interior and various compartments 117, 217 of locker 111, 211, through a plurality of ventilation apertures or grilles 133, 233 formed in back wall 115, 215 of locker 111, 211. Preferably, a grille or aperture 133, 233 (grille is used herein to mean a single aperture or a group of apertures in any arrangement, e.g. circles, squares, other shapes, arranged in any pattern) is arranged through back wall 115, 215 at least an upper extent and a lower extent (near the top and near the bottom) of locker 111, 211 to insure a supply of air to the entirety of the locker or at least the upper and lower compartments thereof.

Grilles 133, 233 may preferably be provided with a damper arrangement or mechanism that permits the partial closure or obstruction of the aperture(s) of grilles 133, 233 to control the flow of air from plenum 131, 231. One or more front or forward ventilation grilles 137, 217 may be provided in the front panels or dividers (forward of back wall 115, 215 and generally between side walls 113, 213) of locker 111, 211 to permit exhaust or intake of air from or to the locker. Alternatively, the natural gaps left between doors and openings in locker 111, 211 can provide the exhaust or intake of air. Grilles 133, 233 and their dampers may be controlled (opened or closed, fully or partially) manually or automatically, as by a programmed computer. Automatically controlled grilles may operate on a "schedule" (e.g. open or closed at night or during daylight hours) or according to airflow or other parameters, such as relative humidity in the locker room and the like.

Figure 7A:
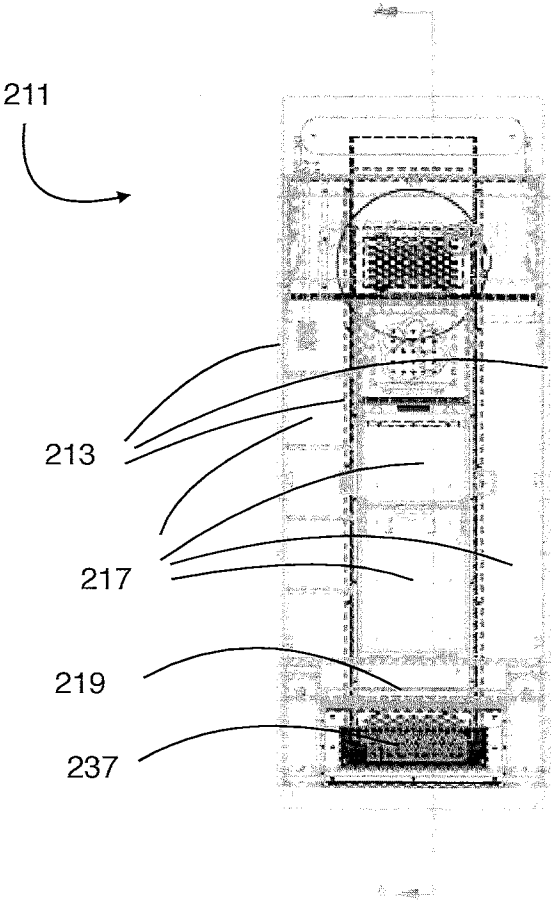
FIGS. 7A through 7C are front, back, and side elevation views, partially in section, of a locker incorporating the equipment storage fixture or rack according to another embodiment of the present application.
Figure 6A:
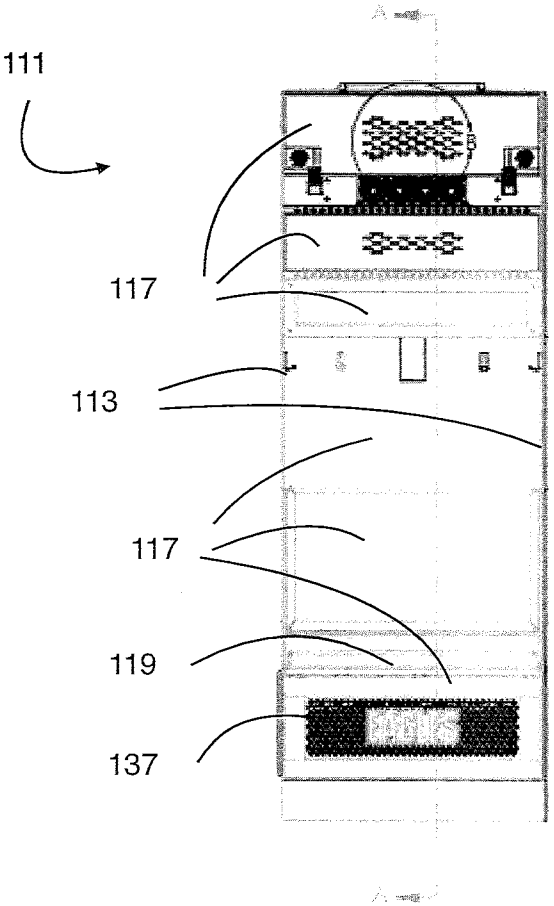
FIGS. 6A through 6D are front, back, and side elevation views, and a perspective view, partially in section, of a locker incorporating the equipment drying fixture of rack according to the present application.
Figure 7B:
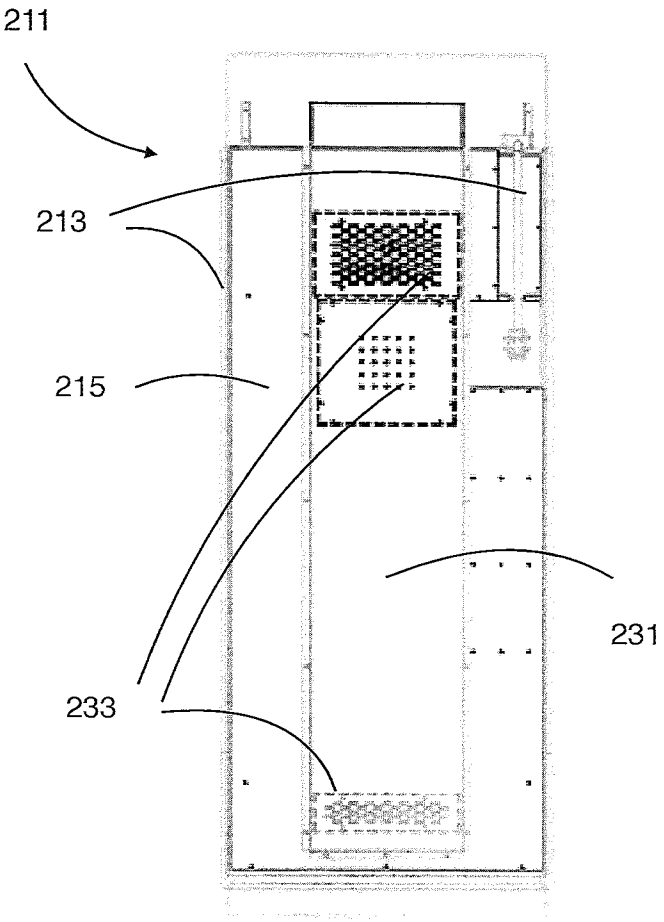
Figure 6B:
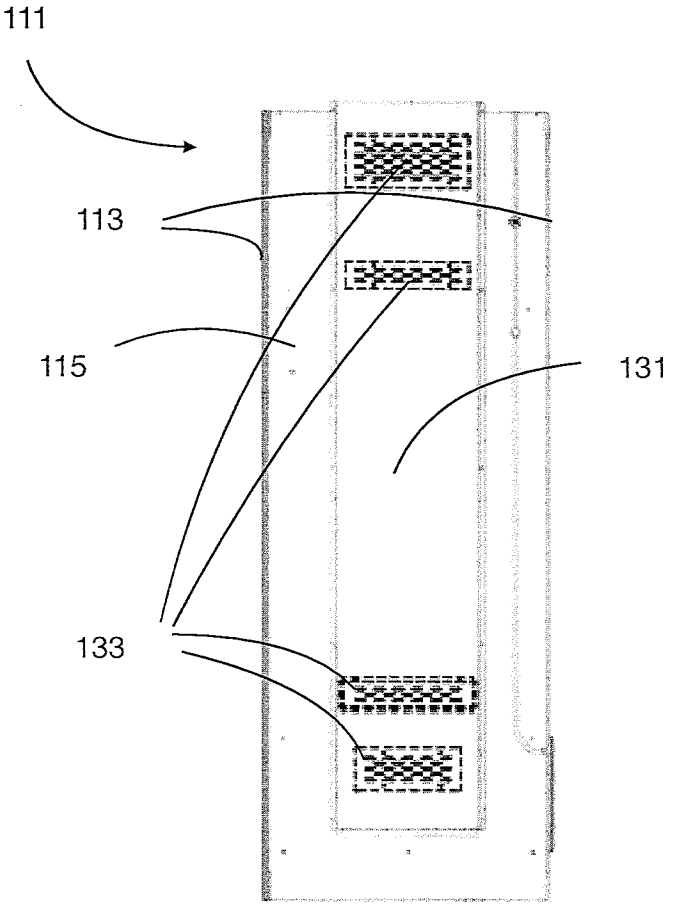
Figure 7C:
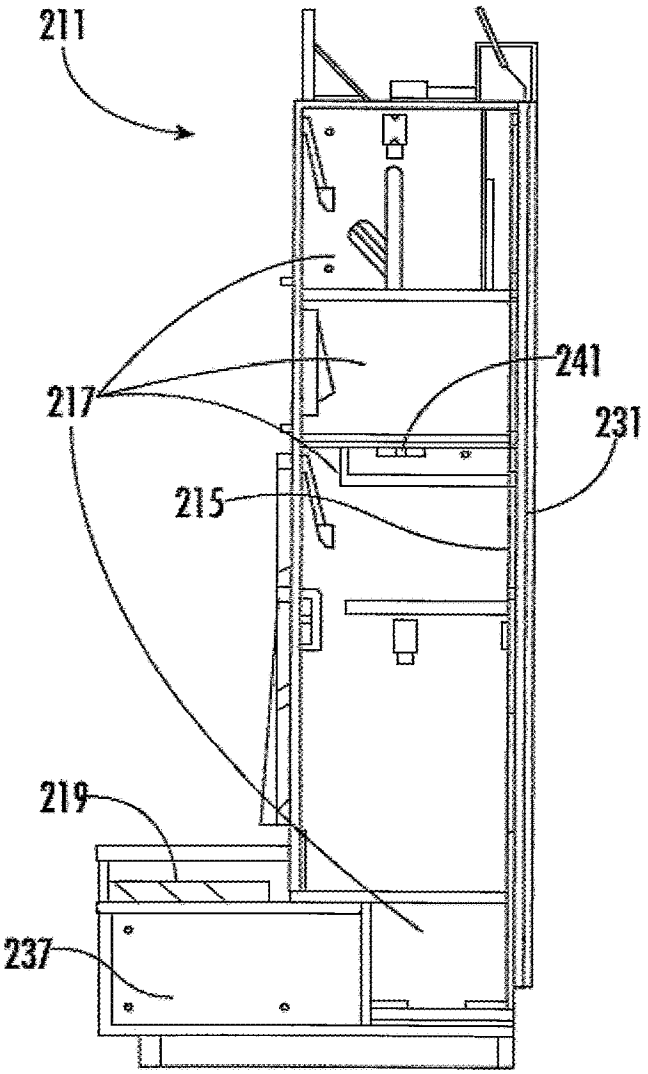
Figure 6C:
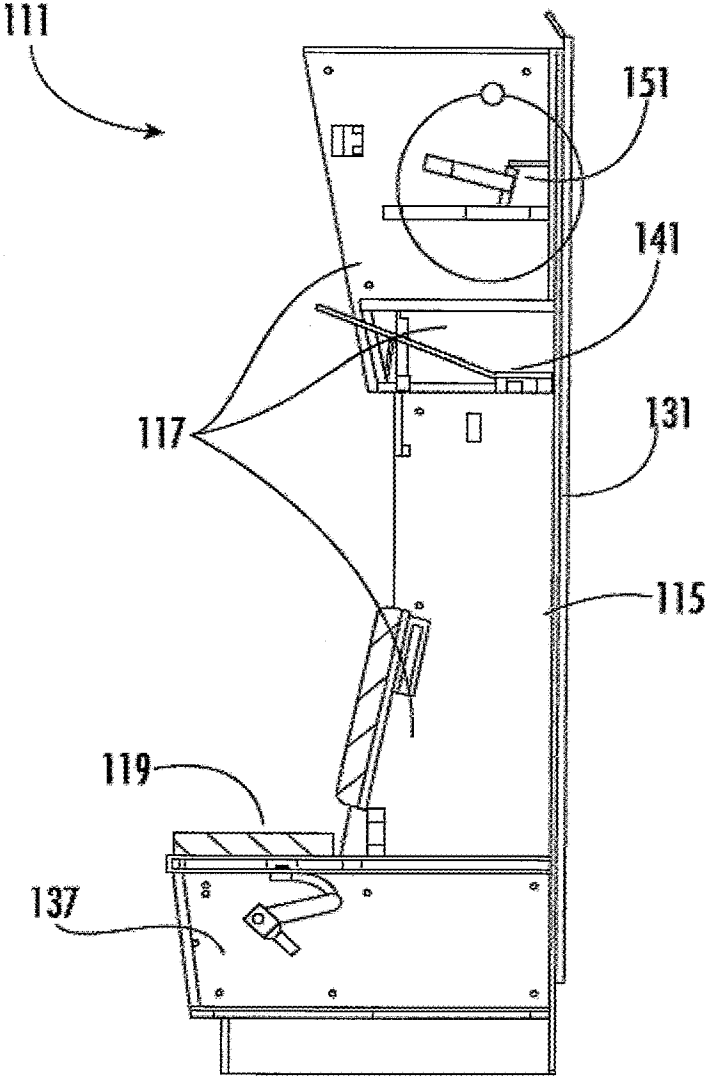

Thus, airflow may be established (either vacuum/suction or positive pressure) through locker 111, 211 from plenum 131, 231, through ventilation grille 133, 233, and exits (or enters in the case of suction) locker 111, 211 through ventilation grille 137, 237 or other openings in the front or forward portions of locker. Alternatively, air circulated through the locker may be exhausted through a duct or conduit to an area remote from lockers 111, 211 and/or the locker room or building in which they are located. This circulation may be assisted by one or more circulation fans 141, 241. Circulation fan 141, 241 may be mounted to the upper or lower surface of a shelf, as illustrated, and the shelf may be provided with flow apertures so that fan 141, 241 can circulate air between the compartments separated by a shelf or divider to insure circulation through the entirety of locker 111, 211. In the embodiment of FIGS. 7A through 7C, for example, fan 241 is mounted under a shelf that forms a helmet storage compartment. Vent holes or apertures in the shelf permit circulation of air from fan 241 up into the helmet resting on the shelf, and may be provided with a ventilation grille, as previously described. A preferred fan 141, 241 is an Arctic F12 Silent 120 mm fan available from ARCTIC GmbH, Fasanenkamp 12, 38108 Braunschweig, Germany.

Figure 8:
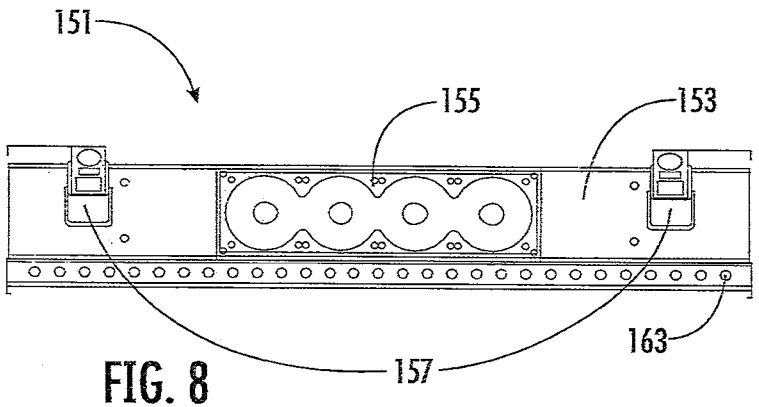
FIGS. 8 and 9 are enlarged front and side views of an equipment drying fixture illustrated in the embodiment of FIGS. 6A and 6D.
Figure 9:
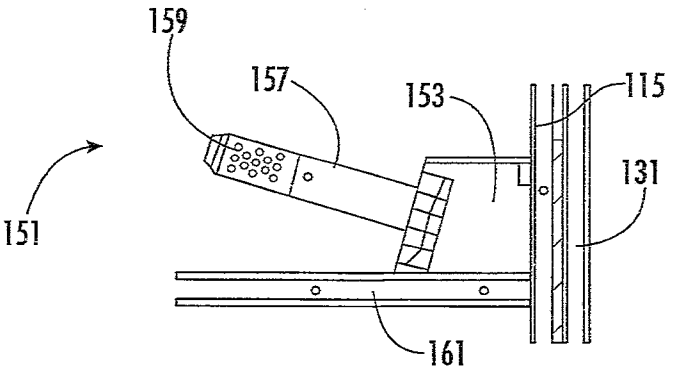
Figure 6D:
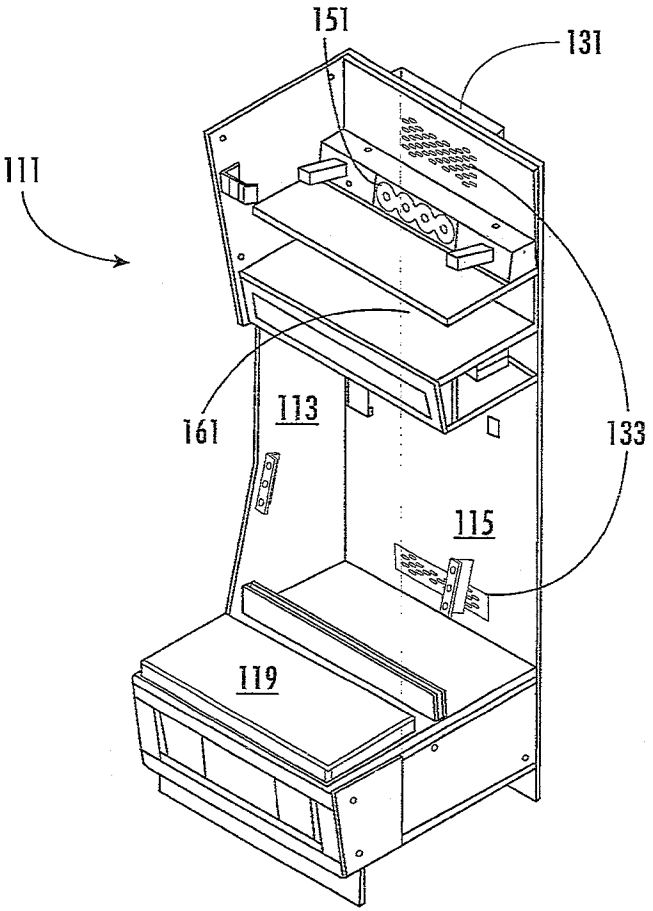

In addition, or as an alternative, to circulation fans 141, 241, equipment-drying fixtures, such as glove and equipment dryer 151, may be provided in one or more compartments. As shown in detail FIGS. 8 and 9, fixture 151 comprises a generally rectangular manifold or plenum 153, that sits at the rear of a shelf 161 adjacent back wall 115 of locker 111. At least one and preferably four fans 155 may be carried by manifold 153 at approximately the midpoint thereof to provide intense air circulation in the central portion of the compartment. A pair of hollow, tubular projections 157 are outboard of fans 155 on either side and in fluid communication with manifold 153. Another fan 159 is carried in a perforated housing at the distal end of each projection 157 to increase air circulation at the distal end of each projection 157. Projections 157 are adapted to be received in the interior of and to support relatively small equipment such as gloves, or even shoes or socks, for drying thereof.

Manifold 153 may be connected to plenum 131 through flow apertures in back wall 115 and thus draws air from the HVAC system. Manifold 153 also draws "ambient" air through shelf 161, which is hollow and features intake apertures 163 at its front edge. Fans 155 may preferably be model QFR0812SH-F00 from Delta Products Corporation, 46101 Fremont Blvd, Fremont, CA 94538. Fans 159 may preferably be ASB0412VHA-AF00, also from Delta Products Corporation.

Figures 10A, 10B:
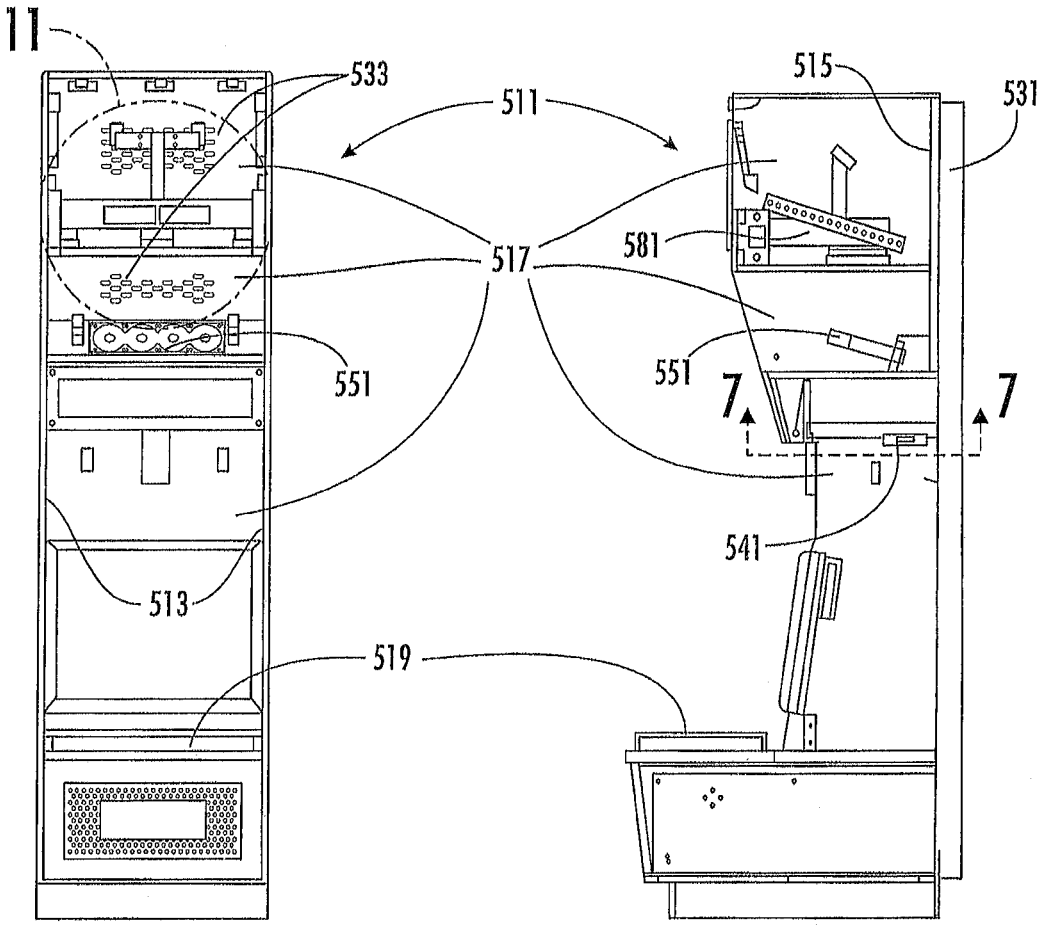
FIGS. 10A and 10B are front and side elevation views of another embodiment of a locker according to the present application.

Referring now also to FIGS. 10A and 10B, FIGS. 10A and 10B are elevation and side views of a locker 511 similar in many respects to those described above, but further adapted for storage of extremely wet equipment for sports such as hockey. One aspect of locker 511 is that locker 511 is constructed entirely of solid phenolic core panel material (available from Wilsonart LLC 2501 Wilsonart Drive, P.O. Box 6110 Temple, Texas 76503-6110) and stainless steel. The panel material is mostly polymeric (rather than fibrous or cellulosic, as in the case of wood and wood products) and resembles wood or wood laminates but is water-resistant and impervious to long-term exposure to moisture.

Locker 511 is generally similar to locker 111, with sidewalls 513, back wall 515, and shelves or horizontal surfaces defining compartments 517. A seat 519 may be provided. A plenum 531 may be carried on back wall 515 to connect to a pre-existing HVAC system to apply negative pressure (vacuum or suction) to the interior of locker 511 to remove or evacuate moisture-laden air. Ventilation grilles 533 may be provided in back wall 515 to draw in air from the exterior of locker 511, and may be provided with dampers or adjustable apertures, as described above.

A plurality (three) of circulation fans 541, as described above, may be secured to the lower surface of a horizontal shelf with appropriate apertures (see FIG. 7) to promote air circulation within locker 511, between upper and lower compartments. A glove or equipment dryer 551, as described above, may be disposed in a medially located compartment 517.

Figure 11:
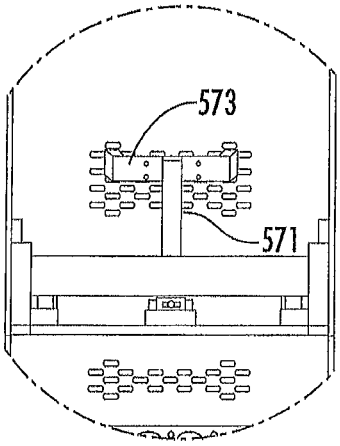
FIGS. 11 and 12 are enlarged elevation views of portions of the locker of FIGS. 10A and 10B.
Figure 12:
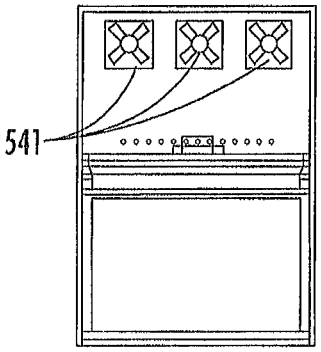
Figure 13:
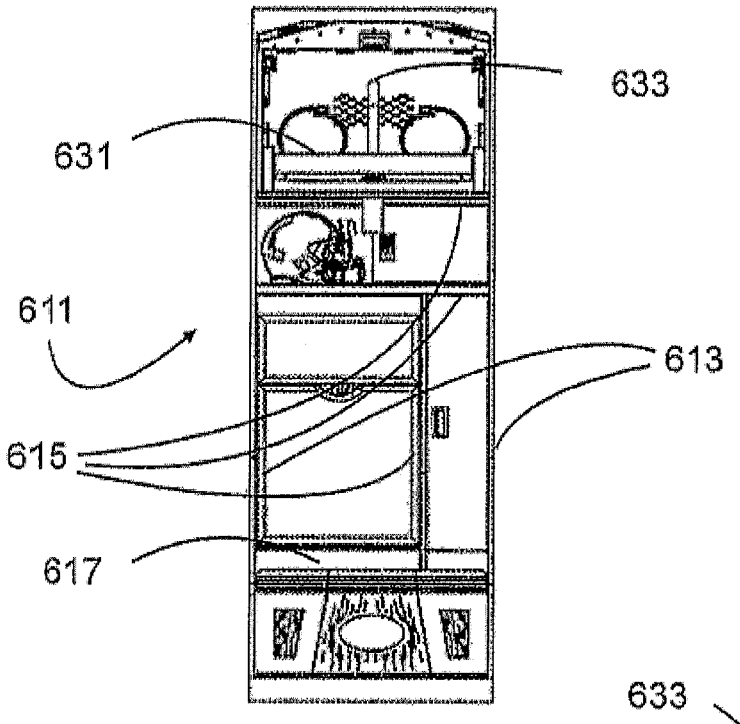
FIGS. 13 and 14 are front and side elevation views, respectively of another embodiment of a locker according to the present application.
Figure 14:
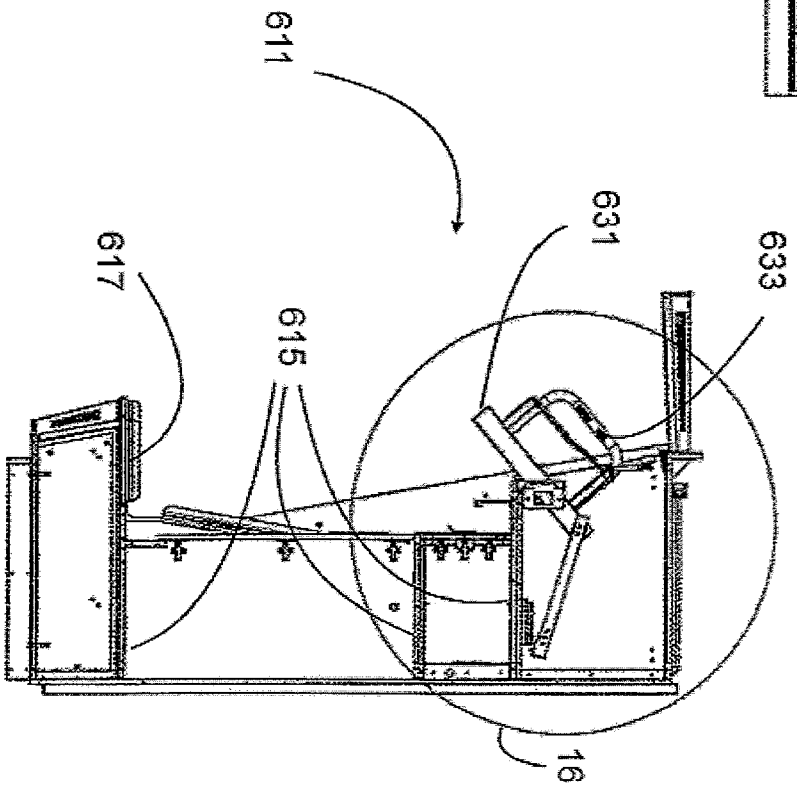

A skate rack 571, 573, may be disposed in an uppermost compartment 517 of locker 511 for storage of ice or roller skates, as shown in greater detail in FIGS. 11 and 12. Rack comprises a vertically extending member 571, with a horizontally extending member or cross bar 573 that provides a pair of horizontally extending projections on either side of vertical member 571 that may be received in the interior of a skate boot to support the skates while stored and drying. The skate rack 571, 573 may be carried on a pull-out drawer 581 that slides in and out of compartment 517 for ease of access.

Referring now also to FIGS. 13 through 17, an embodiment of a locker 611 in accordance with an aspect of the present application is shown. Locker 611 is generally similar to those previously described and includes a pair of sidewalls 613 and a number of horizontal and vertical dividers or sidewalls and shelves 615, which define a number of compartments, including a lowermost "footlocker" compartment with a generally horizontal seat 617.

Figure 15:
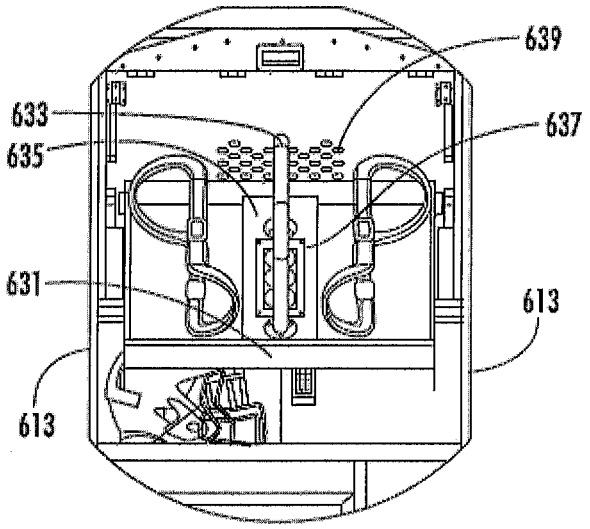
FIG. 15 is an enlarged front elevation view, partially in section, of a portion of the locker of FIGS. 13 and 14.

At an upper extent of locker 611, a horizontal shelf or divider 615 defines an uppermost equipment compartment above a helmet compartment. A tilting and sliding tray 631 may be provided in the equipment compartment immediately above shelf 615 (a pair of knee braces are shown on the tray). An inverted U-shaped tubing equipment rack 633, similar to the shoulder pad rack described above in connection with FIGS. 4 and 5 (but rotated 90 degrees), may be carried on tray 631. As illustrated in FIG. 15, rack 633 may be mounted atop a rectangular box manifold 635, which may be provided with ventilation fans 637, which moves air through shoulder pads or other equipment carried on rack 633. Fans 637 may be model QFR0812SH-F00 from Delta Products Corporation, 46101 Fremont Blvd, Fremont, CA 94538. A ventilation grille or apertures 639 may be provided in the back wall of the compartment to communicate with the locker ventilation system, as described above.

Figure 16:
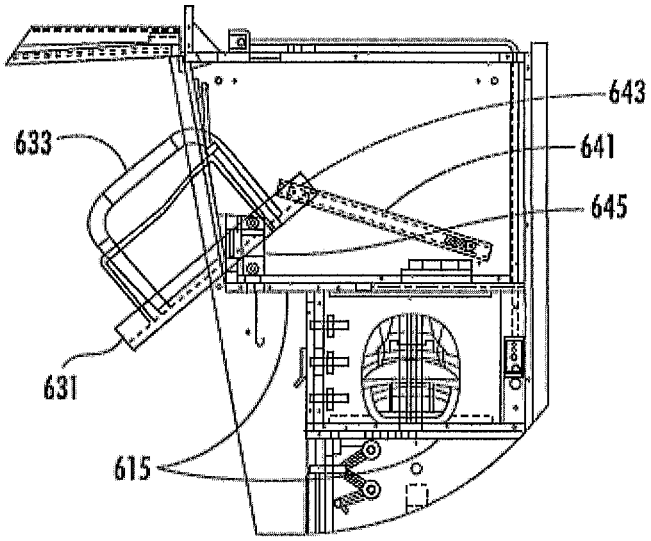
FIG. 16 is an enlarged side elevation view of a portion of the locker depicted in FIG. 13.
Figure 17:
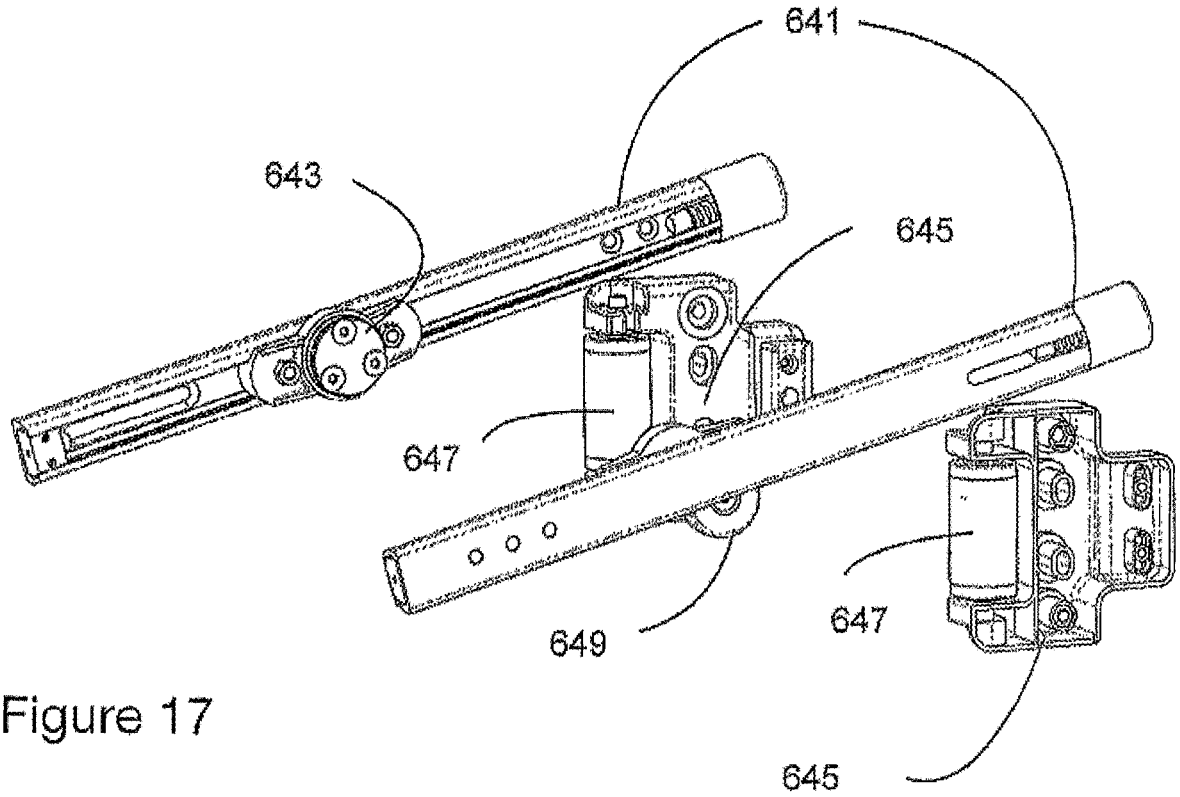
FIG. 17 is an exploded view of the rail and roller system employed in the locker of FIGS. 13 and 14.

Shelf 631 may slide forward and tilt or rotate downward to improve access to equipment stored on tray 631 and rack 633, as depicted in FIG. 16. This motion is enabled by a pair of rails 641 and a pair of roller assemblies 645, as shown in FIG. 17. Rails 641 may be mounted on the sidewalls of the equipment compartment. A sliding pivot 643 is carried by each rail 641. Pivots 643 rotate and slide relative to rail 641. Tray 631 thus may be mounted to pivots 643 and will rotate and slide relative to rail 641, permitting the shelf to move or slide fore and aft within the compartment and also rotate relative to rails 641.

A pair of roller assemblies 645 may be carried at the front of compartment at the corners or intersections of sidewalls 613 and shelf 615. Roller assemblies 645 support tray 631 as tray 631 moves forward and rearward within the compartment. Each roller assembly 645 includes both a vertical roller 647 and a horizontal roller 649 carried by a frame 646, which may be mounted to sidewalls 613, shelf 615, or both. Rollers 647, 649 cooperate to center tray 631 in compartment and support tray 631 as tray 631 tilts and slides. Horizontal rollers 649 become the pivot point around which shelf 631 pivots as shelf 631 tilts or rotates. Rails 641 and roller assemblies 645 are available as model 4070.1000 from Sliding Systems, Gledrid Industrial Park, Chirk, Wrexham, LL14 5DG, United Kingdom.

Referring now also to FIGS. 18A through 18D and FIGS. 19A through 19C, an embodiment of a locker 711 in accordance with an aspect of the present application is shown. Locker 711 is generally similar to locker 111, with sidewalls 713, back wall 715, and shelves or horizontal surfaces defining compartments 717. A seat 719 may be provided. A plenum 731 may be carried on back wall 715 to connect to a pre-existing HVAC system to apply negative pressure (vacuum or suction) to the interior of locker 711 to remove or evacuate moisture-laden air. Ventilation grilles 733 may be provided in back wall 715 to draw in air from the exterior of locker 711, and may be provided with dampers or adjustable apertures, as described above.

Figure 18A:
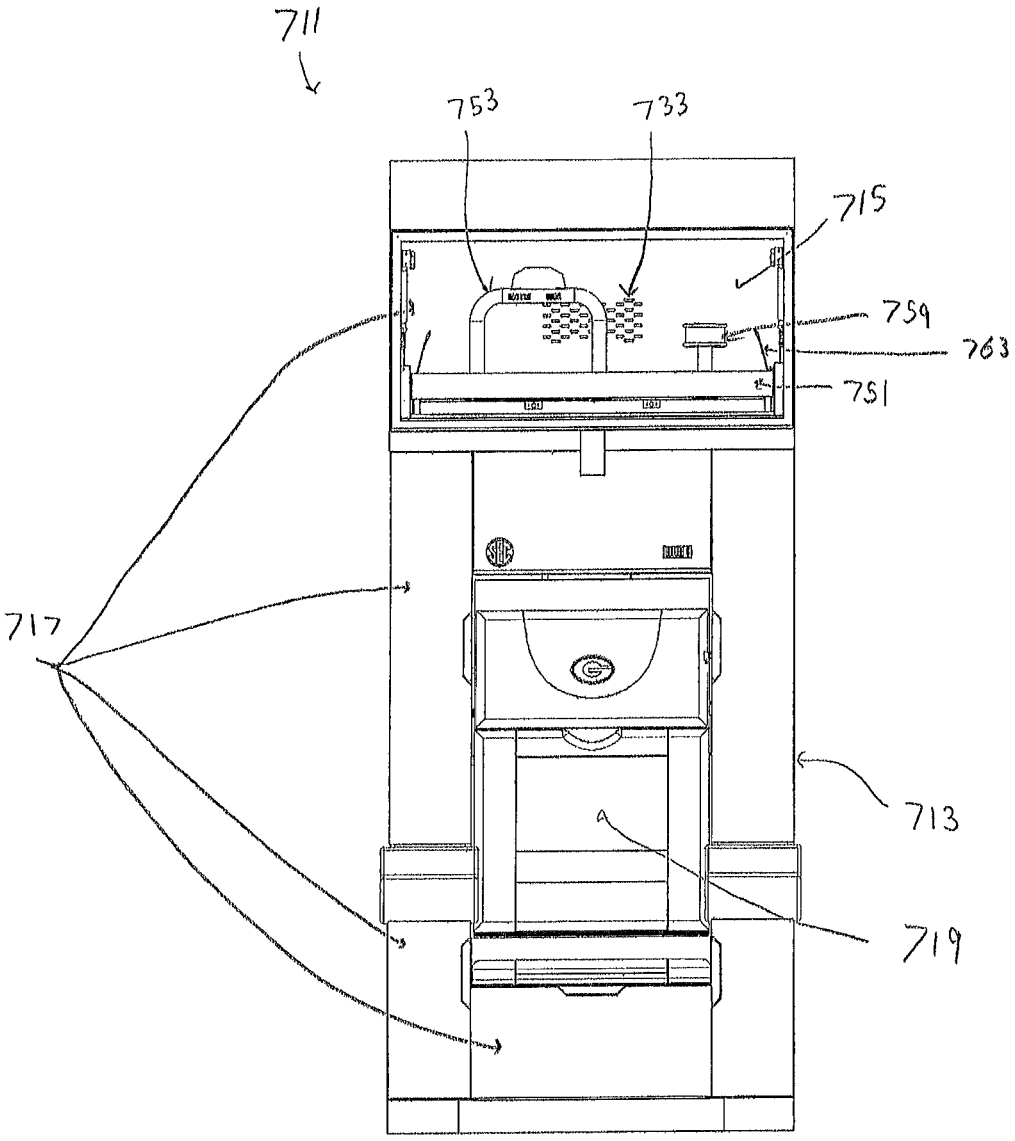
FIGS. 18A through 18D are front, and side elevation views, and a perspective view, partially in section, of a locker incorporating the equipment drying fixture or rack according to the present application.
Figure 18B:
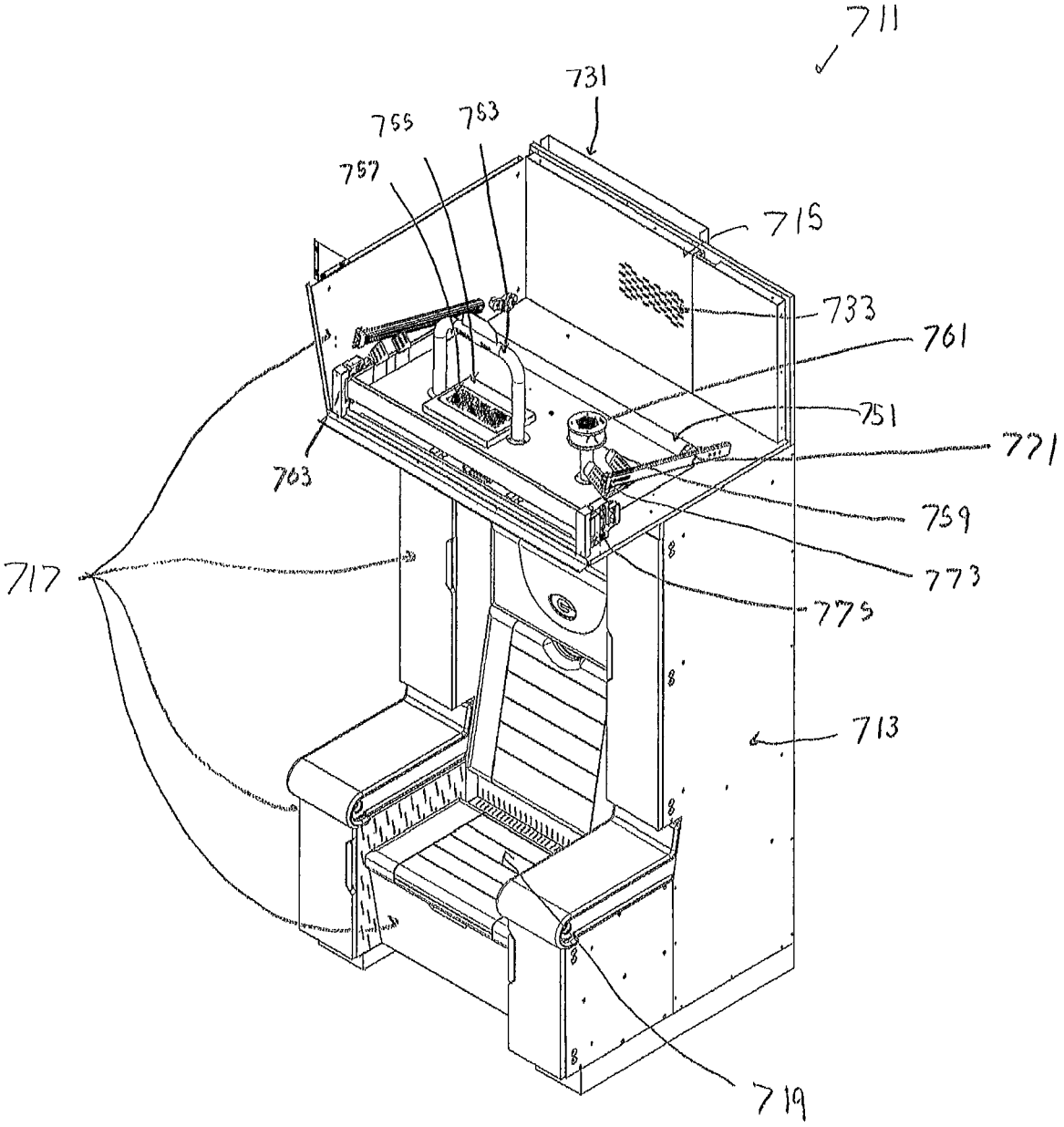
Figure 18C:
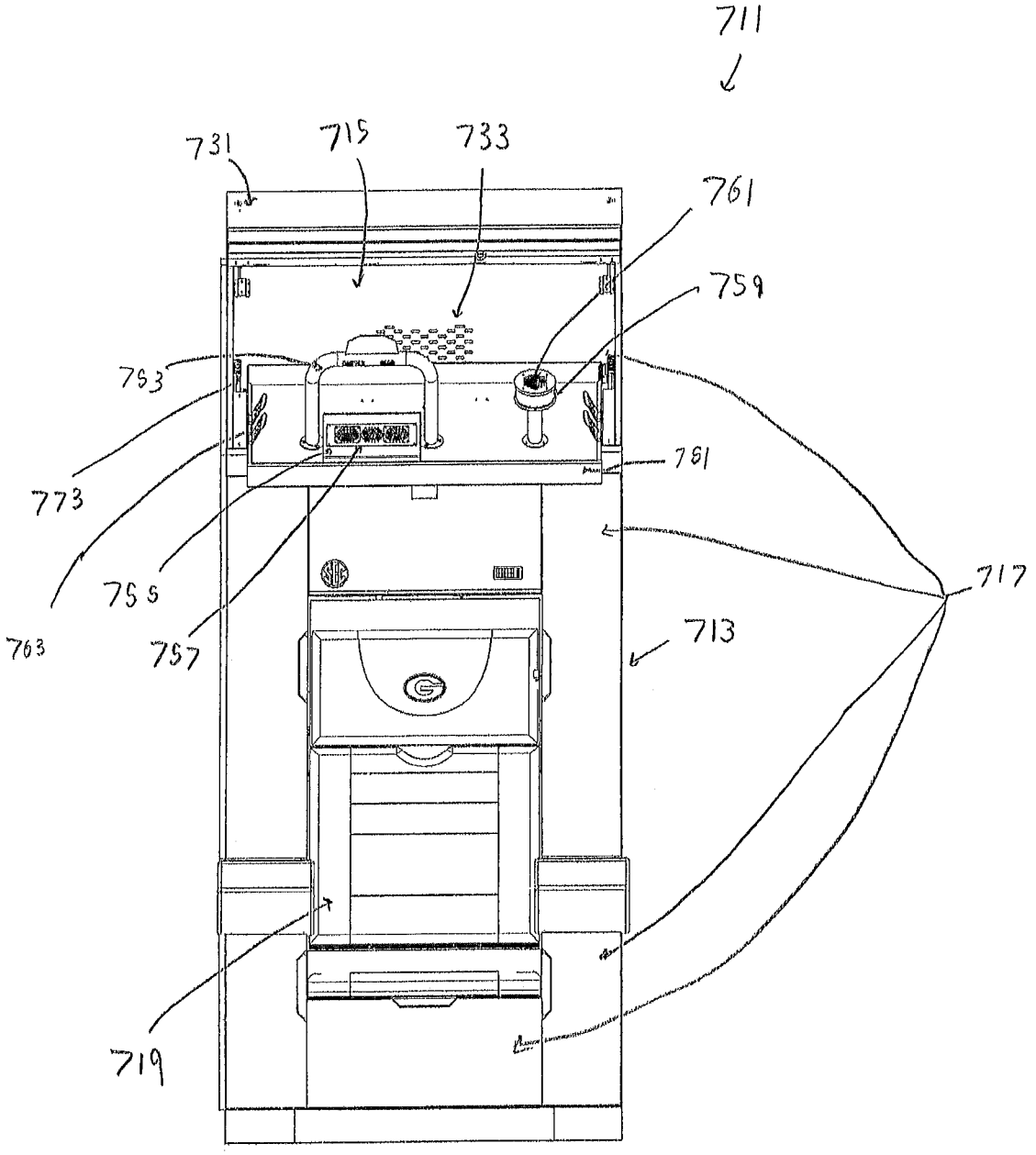

At an upper extent of locker 711, a horizontal shelf or divider 715 defines an uppermost equipment compartment. A tilting and sliding tray 751 is contained within the uppermost equipment compartment. An inverted U-shaped tubing equipment rack 753, similar to the shoulder pad rack described above in connection with FIGS. 4 and 5, may be carried on tray 751. As illustrated in FIG. 18B, rack 753 may be mounted atop a rectangular box manifold 755, which may be provided with ventilation fans 757, which moves air through shoulder pads or other equipment carried on rack 753. Fans 757 may be model QFR0812SH-F00 from Delta Products Corporation, 46101 Fremont Blvd, Fremont, CA 94538. Helmet rack 759 is also located on sliding tray 751 and extends upward from the tray to provide a location to store helmets in the compartment. On the top of helmet rack 759 there is ventilation fan 761 which moves air through the helmet carried on the rack. The sides of sliding tray 751 also have protrusions 763 which may be used to hang and dry gloves or other equipment.

Figure 18D:
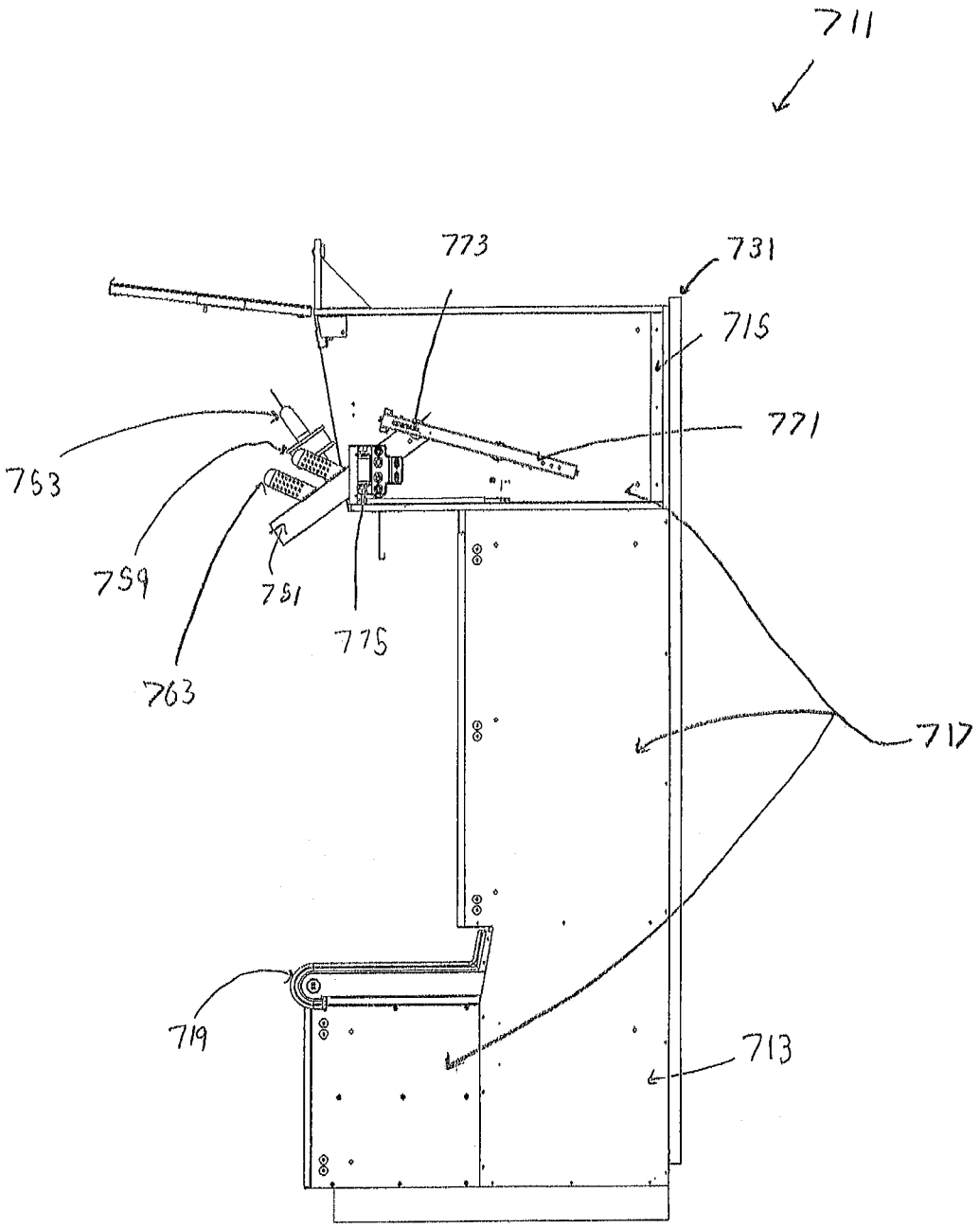
Figure 19A:
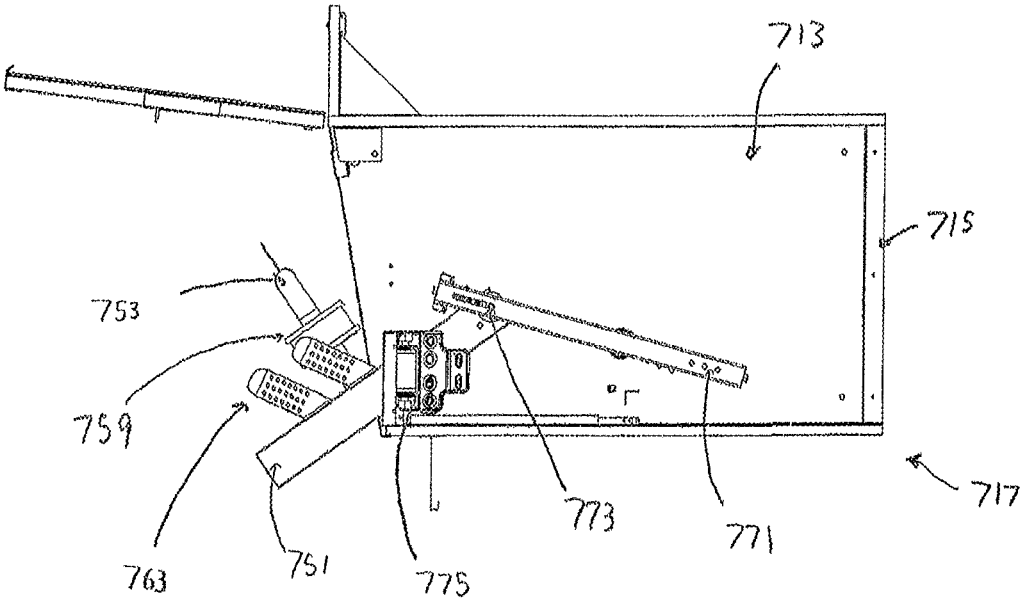
FIGS. 19A through 19C are side, perspective, and an exploded perspective view of a portion of a locker incorporation the equipment drying fixture or rack according to the present application
Figure 19B:
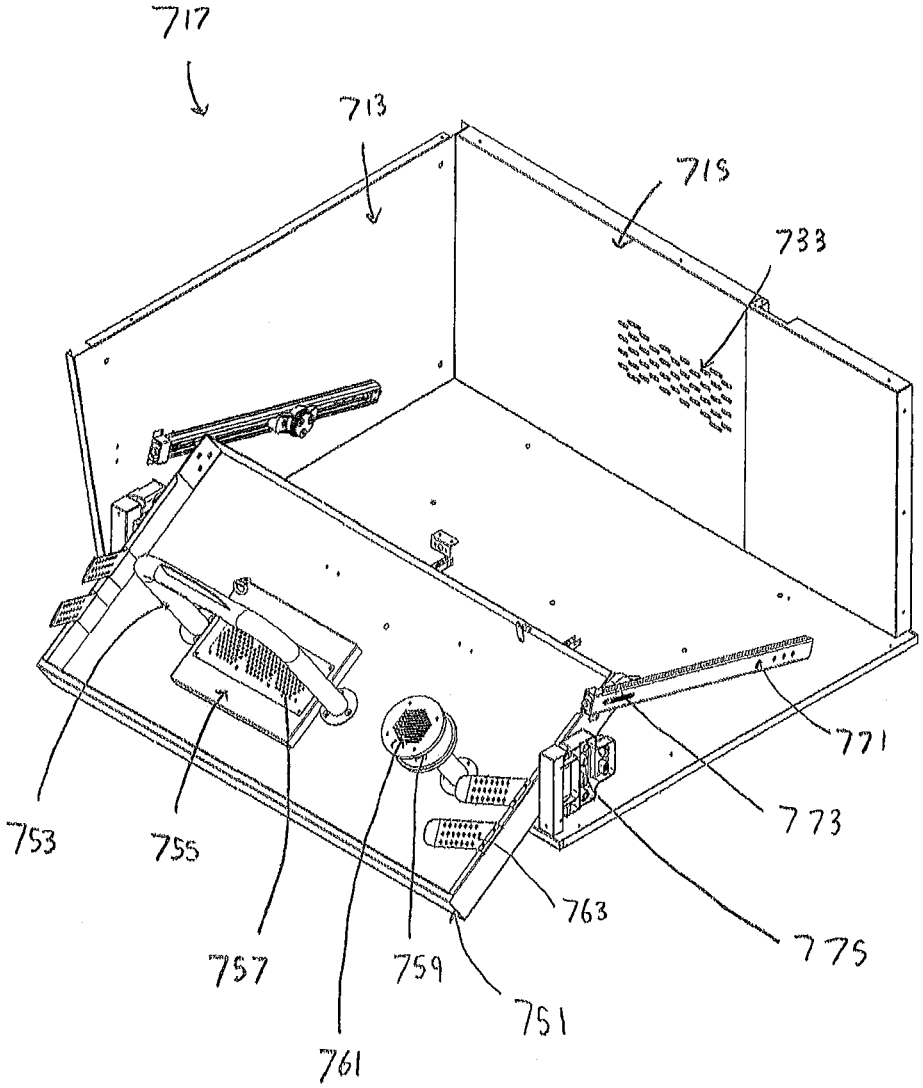
Figure 19C:
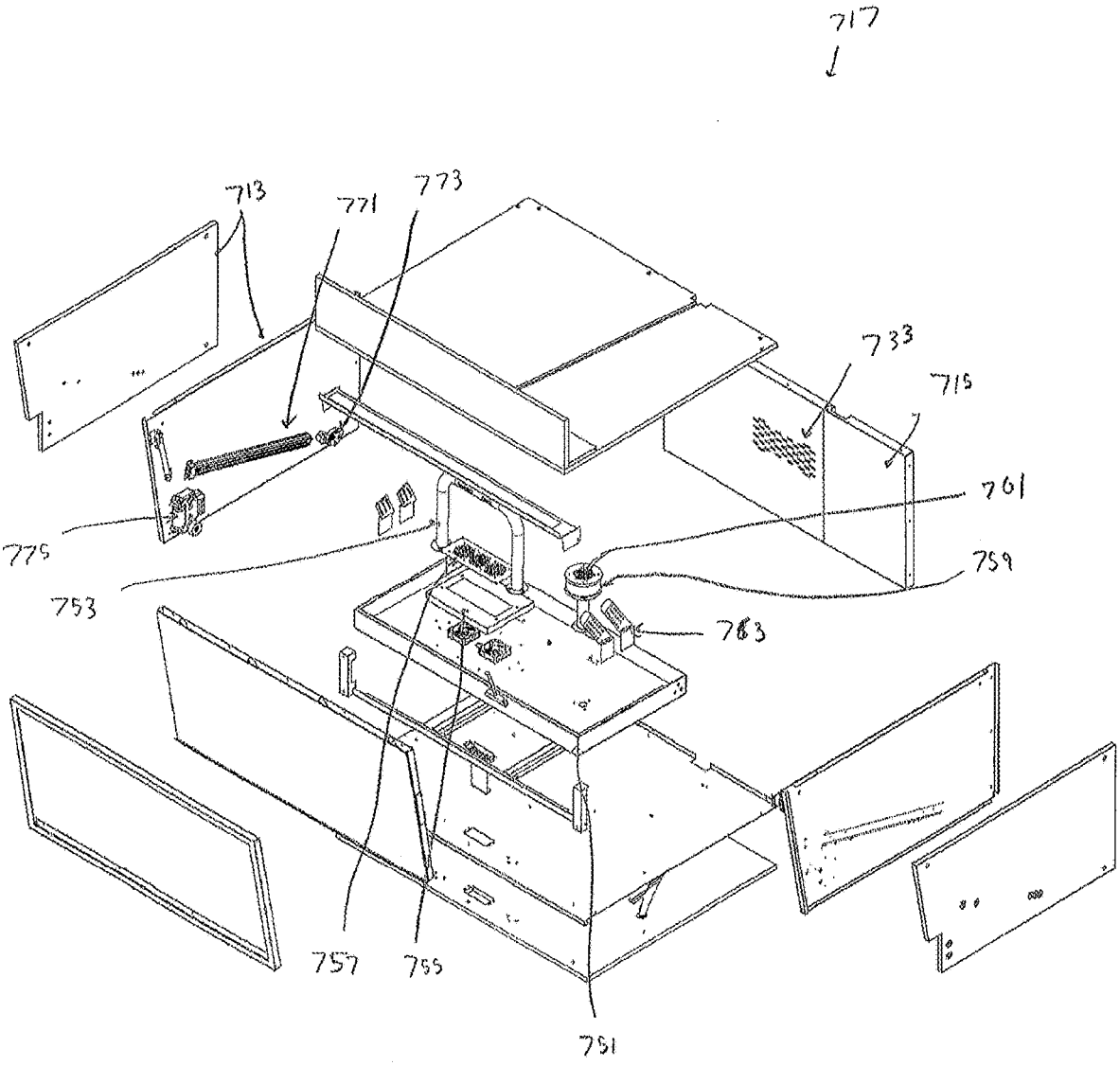

Sliding tray 751 may slide forward and tilt or rotate downward to improve access to equipment stored on tray 751 and rack 753, as depicted in FIG. 18D. This motion is enabled by a pair of rails 771 and a pair of roller assemblies 775, as shown in FIG. 19A. Rails 771 may be mounted on the sidewalls of the equipment compartment. A sliding pivot 773 is carried by each rail 771. Pivots 773 rotate and slide relative to rail 771. Tray 751 thus may be mounted to pivots 773 and will rotate and slide relative to rail 771, permitting the shelf to move or slide fore and aft within the compartment and also rotate relative to rails 771.

Figure 20:
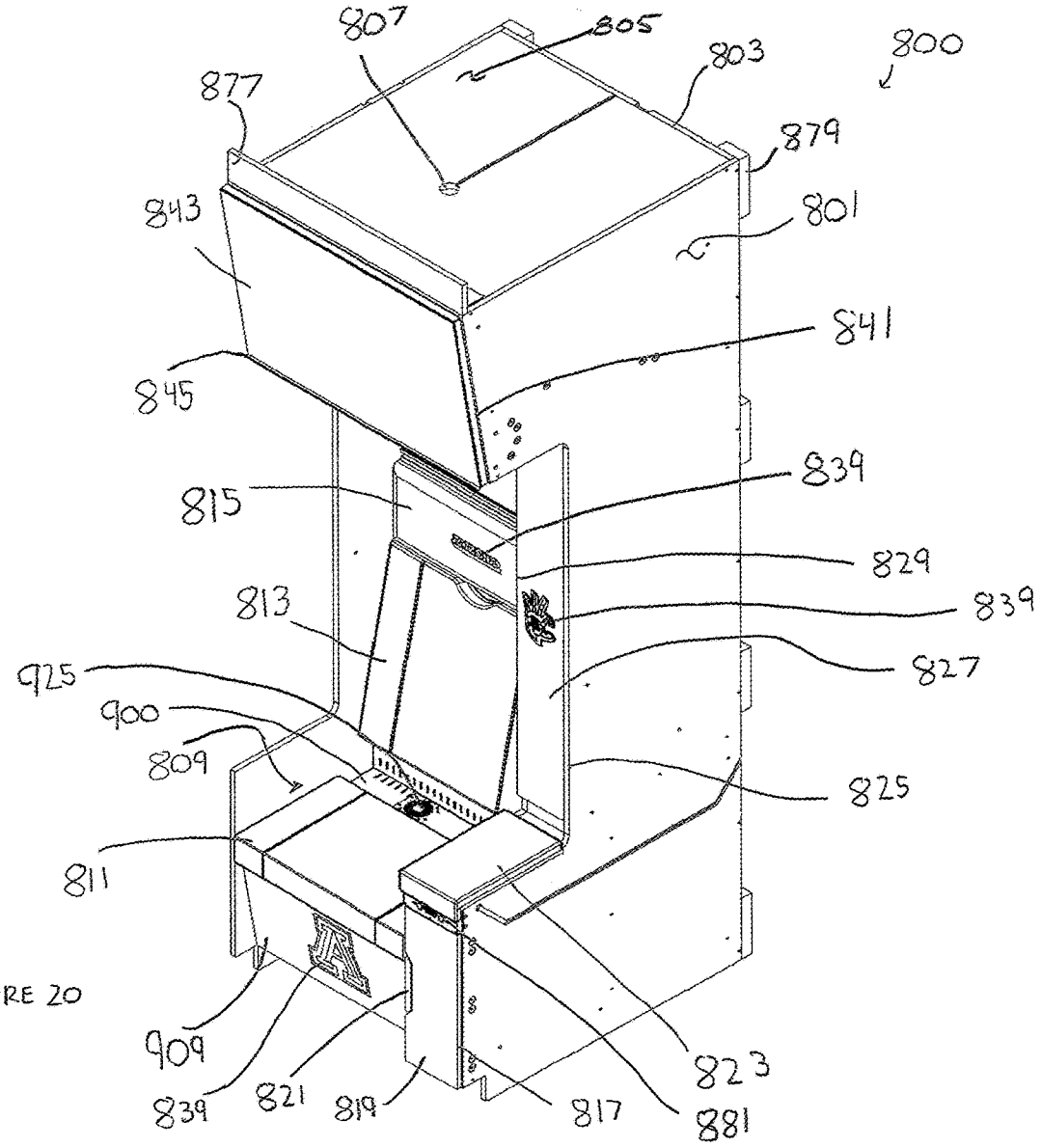
FIG. 20 is a perspective view of the preferred embodiment of a locker incorporating a air conditioning system in the hinge bar according to the present application.

Referring now also to FIG. 20 in the drawings, locker 800 according to the preferred embodiment is depicted. As seen in FIG. 20, locker 800 is comprised of a pair of upstanding side walls 801, back wall 803, top wall 805, top opening 807, seat assembly 809, seat cushion 811, seat backrest 813, seat headrest 815, cabinet 817, cabinet door 819, cabinet door handle 821, arm rest 823, shoe storage 825, shoe storage door 827, shoe storage door handle 829, logo 839, upper compartment 841, upper compartment door 843, upper compartment door handle 845, trim balance 877, wall spacers 879, seat airflow system control panel 881, seat airflow system 900, front panel 909, and primary ventilation fan 925. Located above upper compartment 841 is top opening 807 disposed through top wall 805 which provides a location for a circular light puck to be inserted into top wall 805 of locker 800. The circular light puck inserted into top hole 807 will provide light for the inside of upper compartment 841 and may be activated remotely by an individual or the light puck may be activated automatically when an individual opens upper compartment door 843.

Locker 800 is generally comprised of a pair of upstanding side walls 801 that generally define the main storage area of locker 800. A back wall 803 connects the pair of upstanding side walls 801 at the rear of locker 800 and a top wall 805 connects the pair of upstanding side walls 801 at the top of locker 800 forming the main storage area within locker 800. Side walls 801, back wall 803, and top wall 805 of locker 800 may be made of various materials, including wood, laminates, polymers, metals, and composites. The material choice will depend upon the properties desired for the chosen application and embodiment of locker 800 along with where locker 800 will be housed. Each locker 800 may be installed adjacent to another, similar, or identical locker 800, with locker's 800 back wall 803 oriented towards a wall of a locker room, and locker's 800 front facing the interior of the locker room. Back wall 803 of locker 800 also has a series of wall spacers 879, made from soft material, running from the top to the bottom of locker 800 preventing back wall 803 from being in direct contact with the walls of the locker room housing locker 800. Not having locker 800 be in direct contact with the wall of the locker room may be preferred in some situations where the owner of the locker room does not want the wall to be potentially damaged or marked up by locker 800 or where wiring or other equipment will need to run behind locker 800. Each locker 800 may also be installed behind and facing the opposite direction of another similar or identical locker 800, with locker's 800 wall spacers 879 against the wall spacers 879 of another locker 800. Wall spacers 879 can also be removed and placed on locker 800 only when needed.

Between the sidewalls 801 of locker 800, a plurality of compartments such as cabinet 817, shoe storage 825, and upper compartment 841 are defined by shelves or other horizontally extending surfaces or platforms. As used herein, "sidewall" or "sidewalls" may refer to either "main" sidewalls 801 or other upstanding or generally vertical sidewalls arranged between the "main" sidewalls 801. Multiple additional sidewalls 801 may be placed between the "main" or exterior sidewalls 801 to define general compartments in cooperation with generally horizontally extending shelves or platforms. The sidewalls and shelves of compartments may be made of the same materials as sidewalls 801 and back walls 803, or may be made of differing materials, depending on the desired properties of the specific application and embodiment of locker 800. Each compartment may be sized and otherwise configured for storage of clothing or sporting equipment or other items and may include doors which may be lockable along with electrical outlets or charging ports.

One of the compartments defined within locker 800 is cabinet 817 located at the bottom of locker 800 next to seat assembly 809. While the present application shows only one cabinet 817 on one side of seat assembly 809, it is appreciated that alternative embodiments may exist where cabinet 817 is on either side of seat assembly 809 or where cabinet 817 is on both sides of seat assembly 809. The front of cabinet 817 is enclosed by cabinet door 819 which is hinged to sidewall 801 to allow an individual to open door 819 by pulling on cabinet door handle 821 at the edge of door 819. It is also appreciated that, while not shown, an alternative embodiment may also exist where cabinet door 819 also includes a door lock, either mechanical or electronic, which may be locked and unlocked directly at cabinet 817 or locked and unlocked remotely by the individual using locker 800. On top of cabinet 817 there is arm rest 823 which is a location for an individual sitting in seat assembly 809 to either lean against or rest that individual's arms. Above cabinet 817 but below arm rest 823 is seat airflow system control panel 881 which controls seat airflow system 900 to provide airflow to an individual sitting on seat assembly 809. Seat airflow system control panel 881 may either be activated at locker 800 or an individual will be able to remotely use control panel 881 through an external electronic device.

Positioned above cabinet 817 is shoe storage 825 running the height between arm rest 823 and upper compartment 841. While only one shoe storage 825 is depicted on one side of locker 800 in the present application, it is appreciated that alternative embodiments may also exist where shoe storage 825 may be positioned on either side of locker 800 or where there is shoe storage 825 on both sides of the main storage area of locker 800. The front of shoe storage 825 is enclosed by shoe storage door 827 which, when pulled open by shoe storage door handle 829, shoe storage 825 will be pulled out, along with door 827, away from the front of locker 800 to allow access to the contents of shoe storage 825. It is also appreciated that an alternative embodiment may also exist where shoe storage door 827 includes a door lock, either mechanical or electronic, which may be locked and unlocked directly at shoe storage 825 or locked and unlocked remotely by the individual using locker 800. On the front of shoe storage door 827 there is logo 839 which may be the logo of the team operating out of the locker room where locker 800 resides or logo 839 may be a stylized piece of art or an individual's personal logo. Logo 839 is also found on seat headrest 815 of seat assembly 809 and front panel 909 beneath seat assembly. While each of these spots have logo 839, as shown in the present application, each of these locations have a different style logo 839, however alternative embodiments may also exist where logo 839 is the same throughout locker 800.

Within the main storage area of locker 800 and next to the compartments formed by sidewalls 801 is seat assembly 809. Seat assembly 809 is comprised of seat cushion 811, seat backrest 813, and seat headrest 815. These sections of seat assembly 809 along with arm rest 823 are preferably padded and upholstered with an appropriate material, such as vinyl or leather or other textile material. The material and design choices for seat assembly 809 and arm rest 823 will depend on the desired application and embodiment of locker 800. As described above, logo 839 is positioned on headrest 815 of seat assembly. Logo 839 may be an embroidered logo, a printed logo, an embedded feature, or a separate piece which is removably or permanently attached to headrest 815. While not shown, alternative embodiments may also exist where logo 839 may also be present on other components of seat assembly 809 in addition to or instead of headrest 815.

Positioned above seat assembly 809 and shoe storage 825 is upper compartment 841 running the full length between the pair of upstanding sidewalls 801. The front of upper compartment 841 is enclosed by upper compartment door 843 which has upper compartment door handle 845 also running the length between the pair of upstanding sidewalls 801. It is also appreciated that an alternative embodiment may also exist where upper compartment door 843 includes a door lock, either mechanical or electronic, which may be locked and unlocked directly at upper compartment 841 or locked and unlocked remotely by the individual using locker 800. Disposed above upper compartment 841 and connected to top wall 805 is trim balance 877 which may be constructed from the same material as locker 800 or from material with a similar appearance to the walls of the locker room where locker 800 is placed. If there is a gap between top wall 805 of locker 800 and the roof of the room locker 800 is placed, trim balance 877 can be used to block this gap and provide the appearance that locker 800 is secured between the floor and the ceiling of the locker room. Trim balance 877 is used to both improve the aesthetics of locker 800 when placed into a locker room and to act as a blocker to prevent anything from getting stuck on top of locker 800. An alternative embodiment may also exist where trim balance 877 is instead an illumination panel where messages or names of players can be displayed.

Figure 21:
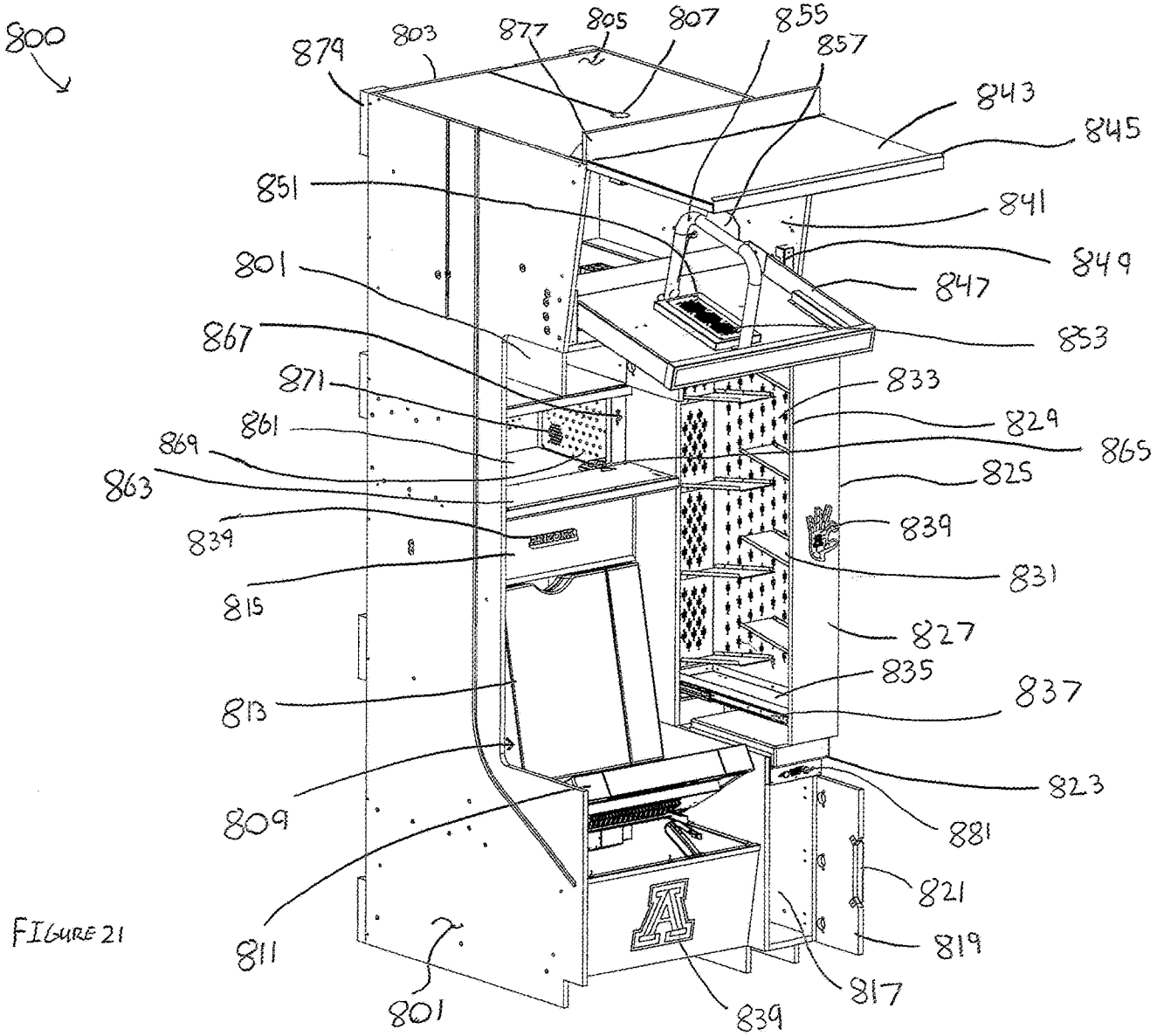
FIG. 21 is a perspective view of the locker with compartment doors open of FIG. 20.
Figure 22:
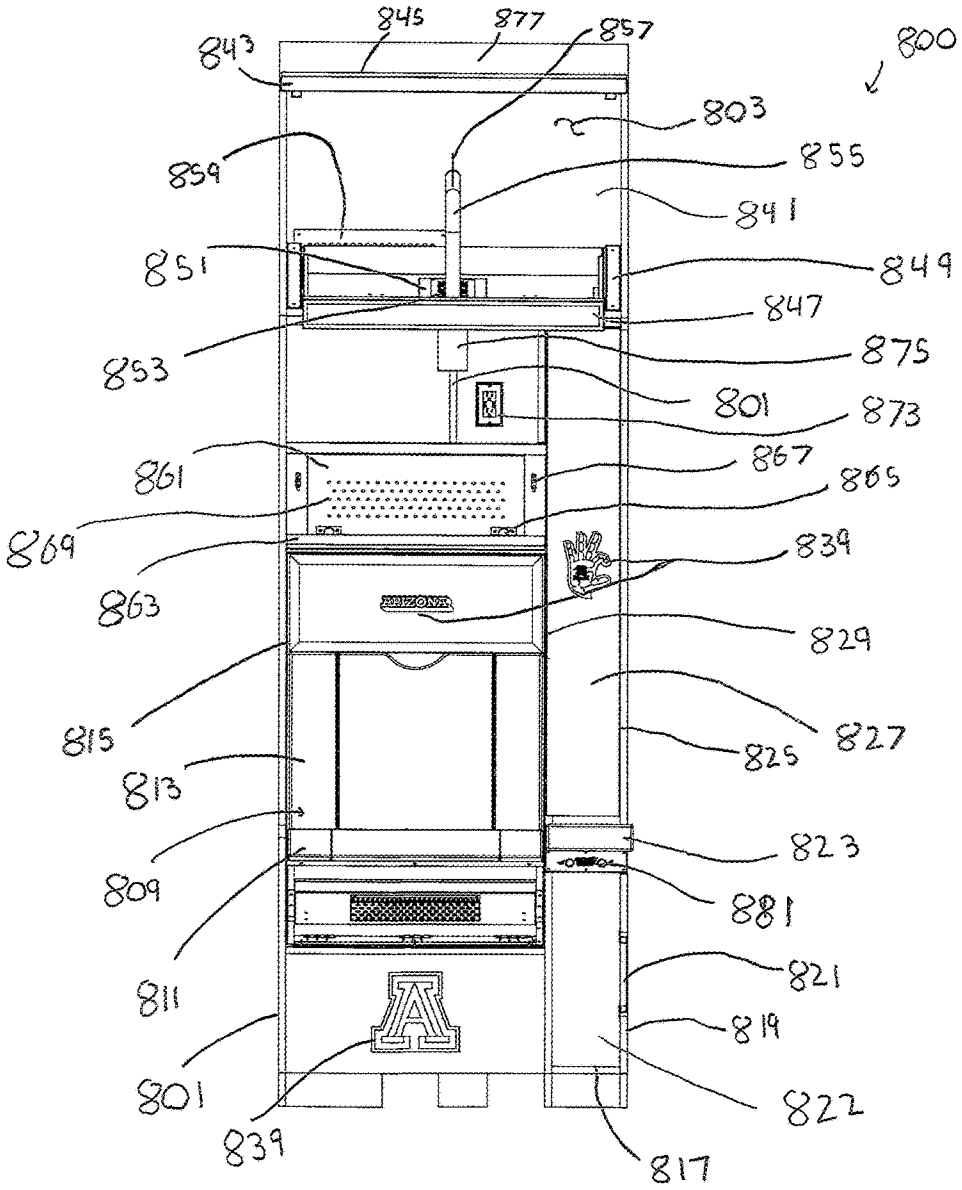
FIG. 22 is a front view of the locker with compartment doors open of FIG. 20.
Figure 23:
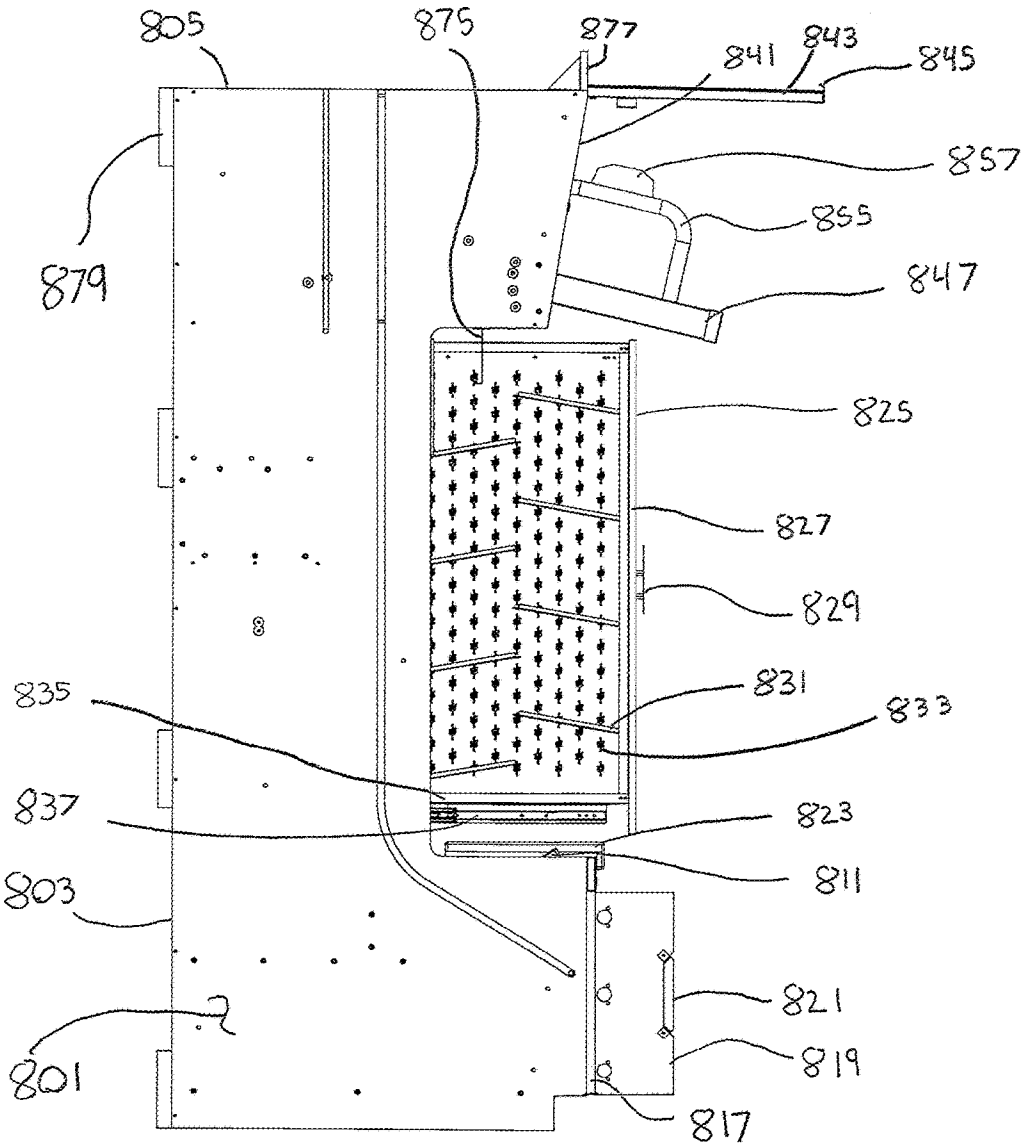
FIG. 23 is a side view of the locker with compartment doors open of FIG. 20.

Referring now also to FIGS. 21-23 in the drawings, differing views of locker 800 with compartments doors open are shown. As seen in these figures, locker 800 is further comprised of cabinet false back wall 822, projections 831, support wall 833, debris tray 835, heavy duty self-closing rail 837, movable tray 847, roller assemblies 849, ventilated equipment rack support 851, ventilation fans 853, ventilation equipment rack 857, equipment rack fin 859, upper compartment ventilation 859, quick dry unit 861, quick dry unit door 863, lower connectors 865, upper connectors 867, wall apertures 869, vent 871, electrical outlet 873, and game day hook 875. As shown in FIGS. 21 and 23, cabinet 817 has an open interior for storage of equipment and personal belongings. While not shown in the present application, it is appreciated that alternative embodiments may also exist where cabinet 817 further has compartment shelves to divide the interior of cabinet 817 into smaller sections for storage. Located at the back of cabinet 817 is cabinet false back wall 822 which sections off cabinet 817 so that cabinet 817 does not extend all the way to the back of locker 800. False back wall 822 is removable and located behind false back wall 822 are ventilation fans and electronic equipment, not shown, used in the operation of air conditioning system 900. The compartment formed by false back wall 822 creates a secure location for the storage of electronic equipment so that water, debris, or other containments will not damage any electrical equipment stored there.

FIGS. 21-23 further show that the main storage area of locker 800 contains various features designed to help store and organize equipment and apparel. For example, in the preferred embodiment according to the present application, locker 800 contains a game day hook 875. Game day hook 875 preferably is removably mounted inside and at the top of the main storage area of locker 800 underneath upper compartment door 843. Game day hook 875 may be easily installed and removed such that hook 875 is only present on days when a user will be wearing game-day equipment. Game-day equipment may be hung in locker 800 before a game or event, after which hook 875 is removed, until the next game or event.

To the side of the main storage area, locker 800 preferably contains shoe storage 825. The shape of shoe storage 825 is defined by a pair of spaced-apart, opposed or opposing front and rear end walls 803, the front of which is shoe storage door 827, connected together by support wall 833, all of which are connected at the top and bottom by top walls 805. Heavy duty self-closing rails 837 are mounted at the top and bottom of end walls 803 and are coupled to the interior of sidewall 801 to permit shoe storage 825 to slide or move between extended and retracted positions. While the current embodiment has heavy duty self-closing rails 837 positioned at the top and bottom of shoe storage 825, alternative embodiments can also exist where rails 837 are located elsewhere along the vertical dimension of shoe storage 825. Shoe storage 825 may vary in height, width, and depth but should be large enough in all dimensions to accommodate at least one pair of shoes and preferably two or more pairs. Shoe storage 825 may also be provided with illumination in the form of LED lights or other illumination sources in alternative embodiments. Such illumination may be controlled by switches that turn the illumination on or off as shoe storage 825 is opened and closed.

As shown in FIGS. 21 and 23, a plurality of pairs of generally opposed or opposing projections 831 are secured within shoe storage 825 in a staggered fashion. Projections 831 serve to temporarily secure and support shoes in a storage position within shoe storage 825. In the preferred embodiment according to the present application, projections 831 are designed to support shoes from underneath, but in other embodiments projections 831 may support footwear by fitting inside the footwear and holding footwear either upright or upside down. Projections 831 preferably are formed of sheet stainless steel, bent at an angle, with a vertical portion riveted, screwed, or otherwise fastened to end walls 803 within shoe storage 825. Projections 831 may be shorter or longer than illustrated to accommodate different sizes or types of shoes (e.g. provided with notches for "flip flops," or shaped differently to accommodate boots or other high-topped shoes) and to accommodate gloves (with or without individual finger projections). Projections 831 may be provided with electric resistance or other heating elements to assist drying of shoes or other equipment. Projections 831 can also be provided with anti-odor, anti-fungal, or anti-bacterial coatings or inserts to prevent odor or infections. Projections 831 may also be adjustable as to length or angle via hinges and other mechanisms so that projections 831 can be customized to accommodate different types of shoes, gloves, and other equipment. Projections 831 may also be hollow and connected to a forced-air ventilation system to provide additional air circulation within and about any footwear or equipment contained in shoe storage 825.

At least one side of shoe storage 825 must be open-faced when shoe storage 825 is extended from locker 800 to permit access to projections 831. A support wall 833 extends between end walls 803 in shoe storage 825 to add strength to the enclosure. In the current embodiment support wall 833 is ventilated to facilitate air flow through shoe storage 825, however, alternative embodiments may also exist where support wall 833 is a solid wall and is not ventilated. The perforations in ventilated shoe storage wall 833 permit air circulation to help stored shoes dry. Air may be supplied to shoe storage 825 by a forced-air ventilation system (either wholly or partially self-contained or coupled to the building's HVAC) or air may be supplied passively through locker 800. Such ventilation may include anti-odor, anti-fungal, or anti-bacterial treatments. A removable debris tray 835 may be disposed at the bottom of shoe storage 825 to catch mud, grass, and other debris from shoes stored in shoe storage 825. Debris tray 835 may be removed, and debris emptied and replaced.

In operation, the user pulls shoe storage 825 from the retracted position into the extended position by using shoe storage handle 829 on the edge of shoe storage door 827. The user then places recently worn, dirty, sweaty, or otherwise wet shoes onto projections 831. Shoe storage 825 then may be closed, and any shoes or equipment contained within will dry. Any dried mud or grass or other debris falling from shoes may land on debris tray 835, which may be removed for disposal of the debris. The components of shoe storage 825 may be constructed from various materials such as metal, wood, laminate, composite, or polymer, depending on the designs of locker 800. In the preferred embodiment according to the present application, shoe storage 825 components are primarily made of stainless steel.

Also shown in FIGS. 21-23 in the drawings, locker 800 is depicted with upper compartment door 843 opened. FIGS. 21-23 show that upper compartment 841 of locker 800 further comprises tray 847, roller assemblies 849, ventilated equipment rack support 851, ventilation fans 853, ventilated equipment rack 855, equipment rack fin 857, and upper compartment ventilation 859. Upper compartment 841 provides a location where individuals can store helmets or other equipment to dry when not being used. Provided within upper compartment 841 there is sliding tray 847. Tray 847 may slide forward and tilt or rotate downward to improve access to equipment stored on vented equipment rack 855, as depicted in FIG. 21. This motion is enabled by a pair of roller assemblies 849 mounted on the interior sidewalls 801 of the upper compartment 841. Tray 847 may be mounted to roller assemblies 849 which allows tray 847 to tilt and slide out of upper compartment 841. Located in the back of upper compartment 841 is upper compartment ventilation 859 as shown in FIG. 22 which provides airflow into upper compartment 841.

Located on top of sliding tray 847 is ventilated equipment rack 855. Ventilated equipment rack 855 is generally arch shaped and, as such, is intended for storage of pads, e.g. shoulder pads, only, and no helmet. Accordingly, equipment rack fin 857, located on top of equipment rack 855, serves to help "center" or locate pads on rack 855. Alternative embodiments may also exist where instead of ventilated equipment rack 855 being used exclusively for pads, ventilated equipment rack 855 can also be used for helmets or other smaller equipment. Ventilated equipment rack 855 is connected to tray 847 with ventilated equipment rack support 851 which has ventilation fans 853 in the center to force air into the equipment stored on rack 855. Ventilation fans 853 may be an electric fan or may be a vented opening connected to the HVAC system of locker 800. The fan or HVAC system may circulate air in, around, and through a helmet or other equipment stored on equipment rack 855 for drying and deodorization purposes. While only a singular ventilated equipment racks 855 is shown in the present application, alternative embodiments may also exist where multiple ventilated equipment racks 855 are used. Alternative embodiments can also exist where helmet rack 759 as described above in the previous embodiment can also be present on tray 847 for greater versatility with what can be stored within upper compartment 841.

Located above seat assembly 809 in the main storage area of locker 800 there is quick dry unit 861 as seen in FIGS. 21 and 22. As seen in these figures quick dry unit 861 is comprised of quick dry unit door 863, lower door connectors 865, upper door connectors 867, wall apertures 869, and vent 871. The sides of quick dry unit 861 are created by side walls 801 and the back of unit 861 is enclosed by back wall 801. The front of quick dry unit 861 is further enclosed by quick dry unit door 863 which can be pulled down to access the interior of unit 861. Quick dry unit 861 provides another location within locker 900 to store equipment for drying by allowing airflow through locker 800 to flow into unit 861 to dry the equipment stored within. Within the walls of quick dry unit 861 are wall apertures 869 and vents 871 which facilitate airflow into and out of unit 861 from either ventilation fans or the passive airflow within locker 800. When closing quick dry unit door 863 to seal in quick dry unit 861, door 863 is secured in place by latching onto lower door connectors 865 and upper door connectors 867 on both sides of unit 861. Lower connectors 865 and upper connectors 867 work together to secure quick dry unit door 863 in place once closed so that the equipment stored inside will dry.

Located above quick dry unit 861 but below upper compartment 841 are two smaller compartments. These compartments use side walls 801 of locker 800 to create extra locations for the storage of equipment. These compartments do not have doors enclosing the compartments and as such these compartments can be used for temporary storage as what is stored there cannot be locked and protected. However, alternative embodiments can also exist where doors are present to enclose these compartments creating extra locations for secure storage within locker 800. A side wall 801 is used in the middle of the space to create these two compartments and in one compartment there is electrical outlet 873 for plugging in electronic equipment.

Figure 24:
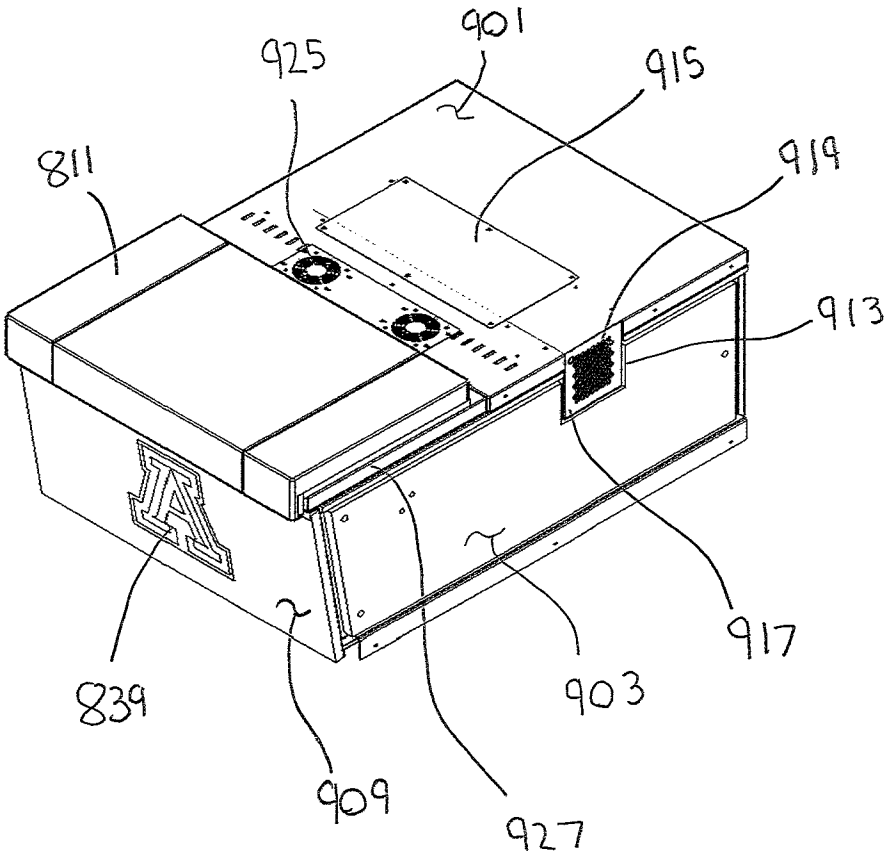
FIG. 24 is a perspective view of the air conditioning system incorporated into the locker of FIG. 20.
Figure 25:
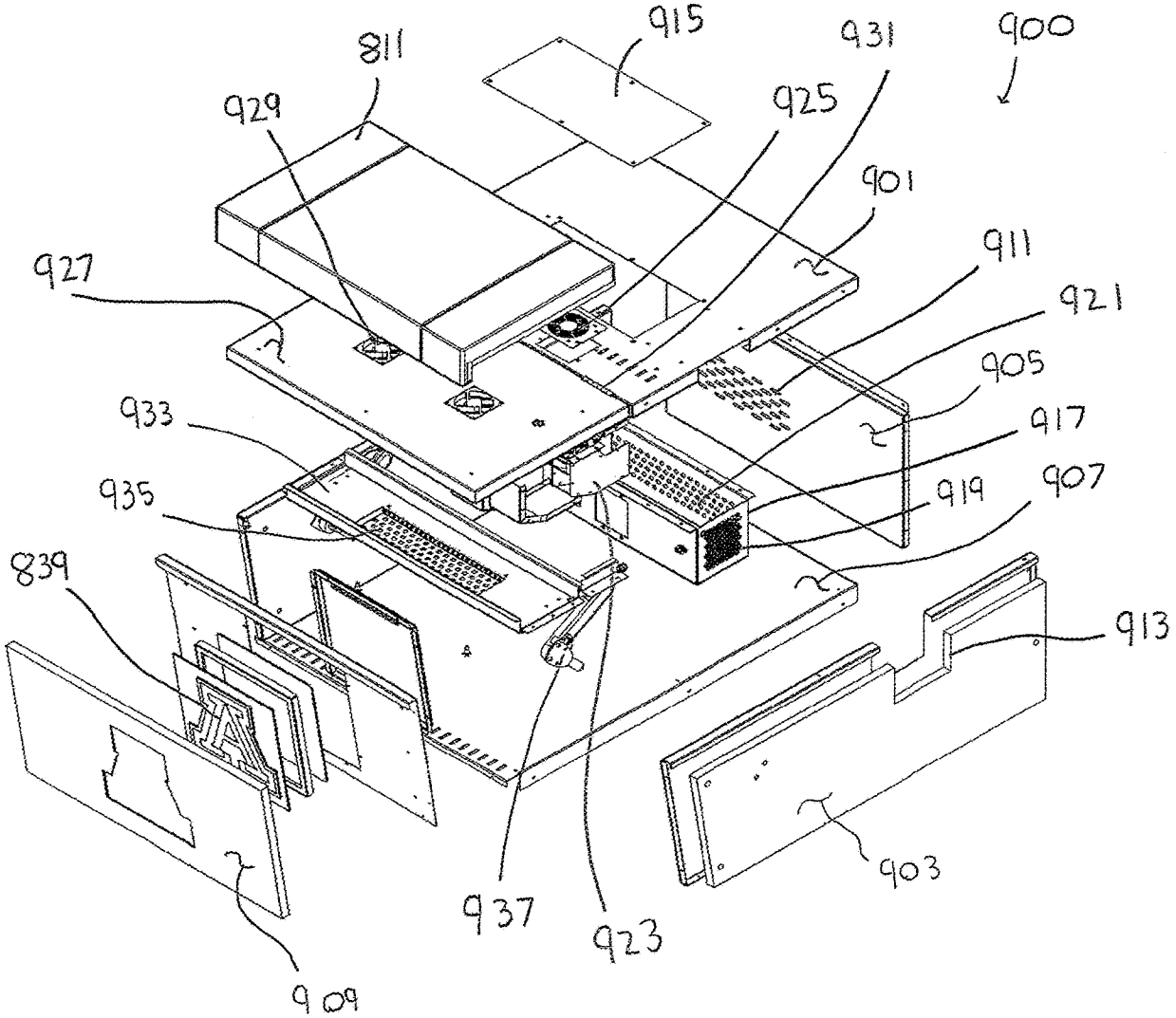
FIG. 25 is a exploded perspective view of the air conditioning system of FIG. 24.
Figure 26:
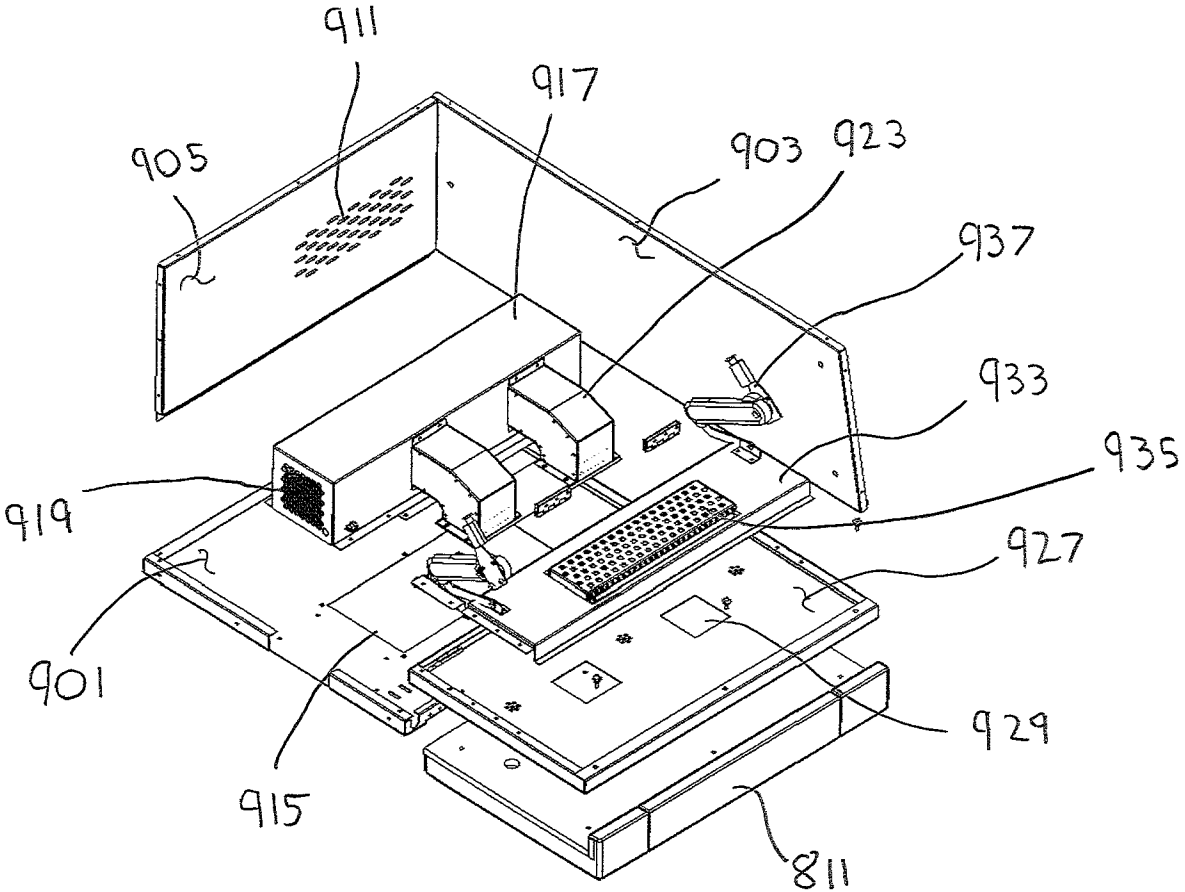
FIG. 26 is a exploded perspective view of the air conditioning system of FIG. 24.

Referring now also to FIGS. 24-26 in the drawings, seat airflow system 900 according to the preferred embodiment is depicted. As seen in these figures, seat airflow system 900 is comprised of a top panel 901, a pair of upstanding side panels 903, back panel 905, bottom panel 907, front panel 909, back panel apertures 911, side panel openings 913, access panel 915, air intake box 917, intake box side apertures 919, intake box top apertures 921, intake box ducts 923, primary ventilation fans 925, seat pan 927, secondary ventilation fans 929, hinges 931, support beam 933, support beam apertures 935, and support arms 937. FIG. 24 shows seat airflow system 900 in a fully constructed view while FIG. 25 and FIG. 26 show seat airflow system 900 in exploded views to display the internal workings of seat airflow system 900.

Seat airflow system 900 is comprised of a pair of upstanding side panels 903 that generally define the extent of the interior area of seat airflow system 900. Back panel 905 connects the pair of upstanding side panels 903 at the rear of airflow system 900, top panel 901 connects side panels 903 at the top of airflow system 900, bottom panel 907 connects side panels 903 at the bottom of airflow system 900, and front panel 909 connects side panels 903 at the front of airflow system 900 to form the interior area within system 900. Top panel 901 does not cover the entire top opening formed by side panels 903, however, top panel 901 is further connected to seat pan 927 which extends out to fully enclose the top of airflow system 900. Seat pan 927 rests on but is not connected to either side panels 903 or front panel 909, and as such, seat pan 927 can be raised to allow access into the interior area of airflow system 900. Bored through the surface of back panel 905 are back panel apertures 911 which allow excess air to flow through system 900. Front panel 909 is a light up panel which can have light-up indica outlining logo 839 within the front surface of panel 909. Top panel 901, side panels 903, back panel 905, bottom panel 907, front panel 909, and seat pan 927 of seat airflow system 900 may be made of various materials including wood, laminates, polymers, metals, and composites. The material choice will depend upon the properties desired for the chosen application and embodiment of seat airflow system 900 or to match the material used in the construction of locker 800.

Inside of seat airflow system 900 is intake box 917 which spans the distance between the pair of upstanding side panels 903. Side panels 903 have side panel openings 913 sized to fit and secure the ends of intake box 917 within side panels 903 so that intake box 917 is suspended within the interior area. Intake box 917 is further fastened to the bottom surface of top panel 901 by screws, bolts, or other fasteners to secure intake box 917 within system 900. The sides of intake box 917 secured through side panel openings 913 have intake box side apertures 919 to allow airflow from within locker 800 to flow into intake box 917. Side apertures 919 of intake box 917 pull air from behind lower cabinet 817, underneath locker 800, and behind locker 800 such that there is a constant supply of fresh air flowing into intake box 917. Once air is flowing into intake box 917, intake box 917 directs the airflow out through intake box top apertures 921 and intake box ducts 923 to direct the flow of air out of seat airflow system 900 towards seat assembly 809.

The top of seat airflow system 900 is comprised of top panel 901 and seat pan 927. Top panel 901 is further comprised of access panel 915 and primary ventilation fans 925 within the surface of top panel 901. Top panel 901 has a rectangular opening which is covered by access panel 915 fastened to the top surface of top panel 901. Access panel 915 can be removed to reveal the opening in top panel 901 which provides a way for an individual to access the interior of seat airflow system 900 through the opening in top panel 901 and provide maintenance to intake box 917. Located between access panel 915 and hinges 931 used to couple top panel 901 and seat pan 927 together are primary ventilation fans 925. As previously described, intake box 917 is fastened to the underside of top panel 901 to secure intake box 917 within seat airflow system 900. When intake box 917 is secured in this manner, intake box ducts 923 are positioned where ducts 923 extend to the underside of primary ventilation fans 925 in top panel 901. When primary ventilation fans 925 are activated by seat airflow control panel 881, fans 925 will pull air from within intake box 917 through intake box ducts 923 and direct the flow of air towards an individual sitting on seat bench 811. Alternative embodiments can also exist where instead of air flowing from intake box ducts 923, primary ventilation fans 925 will pull air from intake box top apertures 921. When air travels through intake box 917, the airflow may either be heated or cooled before the air is pulled up by fans 925. Seat airflow control panel 881 can also be used to set the desired temperature of the air within intake box 917 before being pulled out by primary ventilation fans 925.

Seat pan 927 is connected to the front of top panel 901 by hinges 931. Seat cushion 811 of seat assembly 809 is attached to the top of seat pan 927 such that seat airflow system 900 acts as the base for seat assembly 809. Seat pan 927 further has secondary ventilation fans 929 within the surface of seat pan 927 which are secured within seat pan 927 by support beam 933. Support beam 933 extends from one end of seat pan 927 to the other end and is fastened to the bottom of seat pan 927. Support beam 933 further has support beam apertures 935 which are positioned below secondary ventilation fans 929 such that fans 929 can pull in ambient air from within seat airflow system 900 through apertures 935. When secondary ventilation fans 929 are activated, fans 929 will pull up air from within seat airflow system 900 and push the air into seat cushion 811 of seat assembly 809. The airflow that flows from intake box 917 into seat airflow system 900 when secondary ventilation fans 929 are activated may be either heated or cooled before flowing into the cushions of seat assembly 809. While the current embodiment only shows secondary ventilation fans 929 pushing air against seat cushion 811, alternative embodiments may also exist where additional secondary ventilation fans 929 can be placed elsewhere along seat assembly 809 to allow the airflow from intake box 917 to be pushed against every section of seat assembly 809. Alternative embodiments may also exist where instead of secondary ventilation fans 929 pulling in ambient air from within seat airflow system 900, fans 929 will be positioned above intake box ducts 923 and will pull air directly from intake box 917.

Hinges 931 connecting top panel 901 and seat pan 927 allow an individual to open seat pan 927 by lifting the edge of pan 927 up to access the inside of the front of seat airflow system 900. Connected on either end of support beam 933 and secured to seat pan 927 are support arms 937 which extend to hold up and secure seat pan 927 in place when seat pan 927 is lifted into the open position. Support arms 937 are secured to bottom panel 907 and side panels 903 for increased stability when extending to raise seat pan 927 into the open position. Once seat pan 927 has been raised into the open position and support arms 937 are fully extended, support arms 937 will lock into place keeping seat pan 927 in the open position. Opening seat pan 927 allows individuals to store equipment or personal items within airflow system 900 while also providing another opening for individuals to access the interior of seat airflow system 900 to provide maintenance on intake box 917. To lower seat pan 927 back into place, pressure is applied to the top of seat cushion 811 to disengage support arms 937 and lower seat pan 927 back into the lowered position. During the lowering of seat pan 927, support arms 937 will act as a soft-close feature slowing down the descent of seat pan 927 to prevent seat pan 927 from being damaged or to prevent seat pan 927 from damaging seat airflow system 900.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

What is claimed is:

1. A locker, comprising:

a main storage area defined by a pair of upstanding side walls and a back wall;

a plurality of compartments defined between the sidewalls, including at least one side compartment and at least one center compartment;

a seat assembly disposed within the main storage area, the seat assembly comprising:

a seat cushion;

a seat backrest; and a seat headrest; and a seat airflow system coupled to the seat assembly, the seat airflow system comprising:

an interior area defined by a pair of upstanding side panels, a back panel, a front panel, a bottom panel, a top panel, and a seat pan;

at least one air intake box disposed within the interior area for receiving airflow from the locker;

at least one primary ventilation fan disposed through the top panel for directing airflow towards the main storage area; and at least one secondary ventilation fan disposed through the seat pan for directing airflow against the seat assembly.

2. The locker of claim 1, wherein the seat airflow system further comprises:

at least one opening disposed through a surface of the pair of upstanding side panels for retaining the at least one air intake box.

3. The locker of claim 2, wherein a top surface of the at least one air intake box is fastened to a bottom surface of the top panel.

4. The locker of claim 1, wherein the at least one air intake box comprises:

at least one side aperture disposed through a side of the at least one air intake box for receiving airflow from the locker;

at least one top aperture disposed through a top surface of the at least one air intake box for releasing airflow into the interior area; and at least one intake box duct disposed on a front surface of the at least one air intake box for directing airflow out of the at least one air intake box.

5. The locker of claim 4, wherein the at least one intake box duct directs airflow to the at least one primary ventilation fan.

6. The locker of claim 4, wherein the at least one intake box duct directs airflow to the at least one secondary ventilation fan.

7. The locker of claim 1, wherein the airflow flowing through the at least one air intake box can be cooled or heated.

8. The locker of claim 1, wherein the seat airflow system further comprises:

a opening disposed through the top panel; and a removable access panel coupled to a top surface of the top panel to cover the opening;

wherein the opening is positioned over the intake box, such that the intake box can be accessed through the opening when the removable access panel is uncoupled.

9. The locker of claim 1, wherein the seat airflow system further comprises:

at least one hinge connecting the seat pan to the top panel;

wherein the seat pan is openable along the at least one hinge.

10. The locker of claim 9, wherein the seat airflow system further comprises:

at least one support arm operably associated with the seat pan;

wherein the at least one support arm supports the seat pan when the seat pan is lifted into an open position.

11. The locker of claim 10, wherein the at least one support arm is soft-closing, such that the at least one support arm will slow the rate of descent when the seat pan is closed.

12. The locker of claim 1, wherein the seat airflow system further comprises:

a support beam connected to a bottom surface of the seat pan for retaining the at least one secondary ventilation fan.

13. The locker of claim 1, wherein the seat airflow system is coupled to a bottom surface of the seat cushion.

14. The locker of claim 1, further comprising:

a control panel disposed within the main storage area for controlling the activation of the seat airflow system.

15. The locker of claim 1, wherein the seat airflow system is remotely activated.

* * * * *